US006787978B2

(12) United States Patent
Yura et al.

(10) Patent No.: US 6,787,978 B2
(45) Date of Patent: Sep. 7, 2004

(54) PLASMA DISPLAY PANEL AND PLASMA DISPLAY DEVICE

(75) Inventors: Shinsuke Yura, Tokyo (JP); Shigeki Harada, Tokyo (JP); Ko Sano, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 110 days.

(21) Appl. No.: 09/993,692

(22) Filed: Nov. 27, 2001

(65) Prior Publication Data

US 2002/0063510 A1 May 30, 2002

(30) Foreign Application Priority Data

Nov. 28, 2000 (JP) ..... P2000-361185

(51) Int. Cl.[7] ..... H01J 11/02

(52) U.S. Cl. ..... 313/483; 313/484; 313/485; 313/582; 315/169.3; 428/690

(58) Field of Search ..... 313/483, 495, 313/496, 497, 513, 484, 485, 514, 582; 315/169.3; 428/690; 445/24, 25

(56) References Cited

U.S. PATENT DOCUMENTS 6,323,596 B1 * 11/2001 Ito et al. ..... 315/169.3

FOREIGN PATENT DOCUMENTS

| | | |
|---|---|---|
| JP | 11-288250 | 10/1999 |
| JP | 2000-298451 | 10/2000 |
| JP | 2000-357463 | 12/2000 |

OTHER PUBLICATIONS

T. Komaki, et al., The Journal of the Institute of Image Information and Television Engineers, vol. 54, No. 8, pp. 1180–1184, "High–Luminance AC–PDP with Waffle–Structured Barrier Ribs", 2000 (with English Abstract).

* cited by examiner

*Primary Examiner*—Nimeshkumar D. Patel
*Assistant Examiner*—Sharlene Leurig
(74) *Attorney, Agent, or Firm*—Oblon, Spivak, McClelland, Maier & Neustadt, P.C.

(57) ABSTRACT

A PDP with improved luminous efficiency is provided which prevents erroneous discharge and emission in adjacent cell spaces (8) and which effectively takes out light produced in the cell spaces (8), and a plasma display device having the PDP is also provided. The space between a front substrate (not shown) and a back substrate (1) is sectioned into a plurality of independent cell spaces (8) by grid-like barrier ribs (2). The cell spaces (8) include discharge cells (9) and non-discharge cells (10). The discharge cells (9) and the non-discharge cells (10) are alternately arranged in horizontal and vertical directions (in alternate checkers). A phosphor (3) is applied in the discharge cells (9) and the phosphor (3) is not applied in the non-discharge cells (10).

20 Claims, 19 Drawing Sheets

— PRIOR ART —

— PRIOR ART —

— PRIOR ART —

PLASMA DISPLAY PANEL AND PLASMA DISPLAY DEVICE

BACKGROUND OF THE INVENTION

1. Field of the Invention

The present invention relates to the structure of a plasma display panel (referred to as a PDP hereinafter), and particularly to the structure of an AC surface discharge type PDP and a plasma display device using the PDP.

2. Description of the Background Art

FIG. 20 is a perspective view schematically showing the structure of a conventional PDP 300. For convenience of explanation, FIG. 20 shows the front substrate 12 and the back substrate 1 separated from each other, but in practice the front substrate 12 is placed so that the edges of the barrier ribs 2 abut on a protective film 14 described later. Also in FIG. 20, a dielectric film 13, described later, and the protective film 14 formed on the dielectric film 13 are shown with broken lines, so that the configuration of transparent electrodes 6 etc. can be seen. FIG. 21 is a plan view schematically showing the structure of the PDP 300; for convenience of explanation, FIG. 21 does not show the front substrate 12, dielectric film 13, protective film 14, phosphors 3 and address electrodes 7. FIG. 22 is a sectional view schematically showing the structure of the PDP 300 taken along the line H—H in FIG. 21; FIG. 22 shows the front substrate 12, dielectric film 13, protective film 14 and phosphors 3 which are not shown in FIG. 21. FIG. 22 does not show the address electrodes 7.

The front substrate 12 and the back substrate 1 are disposed in parallel to face each other at a given distance. The space between the front substrate 12 and the back substrate 1 is partitioned into a plurality of independent cell spaces 8 by the grid-like barrier ribs (also referred to as ribs) 2 formed on the back substrate 1. Such structure of the barrier ribs 2 is called a waffle rib structure.

The front substrate 12 forms the display surface; on the front substrate 12, bus electrodes 4X and 5Y, transparent electrodes 6 and black stripes 16 are formed on the side facing the back substrate 1. The dielectric film 13 is formed to cover the bus electrodes 4X and 5Y, the transparent electrodes 6 and the black stripes 16, and the protective film 14 is formed thereon. The bus electrodes 4X and 5Y are formed of a double-layered structure of black silver and white silver, the transparent electrodes 6 are formed of an ITO film (an alloy oxide film of indium and tin), the protective film 14 is formed of an MgO (magnesium oxide) film, and the black stripes 16 are formed of a black insulating material. The bus electrodes 4X and 5Y and the black stripes 16 are disposed so that, when the front substrate 12 and the back substrate 1 are bonded together, they overlap the barrier ribs 2, seen from the display surface. The black stripes 16, disposed between the bus electrodes 4X and 5Y, are formed after formation of the bus electrodes 4X and 5Y. Each transparent electrode 6 is T-shaped, with its one end connected to the bus electrode 4X or 5Y. The transparent electrodes 6 protrude over the cell spaces 8 from the connections with the bus electrodes 4X and 5Y. The T-shaped electrodes contribute to appropriate control of the discharge spreading to enhance the luminous efficiency. In the PDP 300, the transparent electrodes 6 extending from the bus electrodes 4X and the transparent electrodes 6 extending from the bus electrodes 5Y form pairs to produce given discharges.

The back substrate 1 has address electrodes 7 which three-dimensionally intersect with the bus electrodes 4X and 5Y; the address electrodes 7 are disposed approximately in the middle of the cell spaces 8. A dielectric layer 15 is formed on the back substrate 1 to cover the address electrodes 7 and the grid-like barrier ribs 2 are formed thereon.

A phosphor 3R for red (R) emission, a phosphor 3G for green (G) emission, or a phosphor 3B for blue (B) emission (referred to also as "phosphors 3" together) is applied in the cell spaces 8 which are formed by the back substrate 1, the barrier ribs 2 and the front substrate 12; all cell spaces 8 thus form discharge cells. More specifically, the phosphors 3 are applied on the back substrate 1 and the side surfaces of the barrier ribs 2 forming the cell spaces 8. When the direction in which the bus electrodes 4X and 5Y extend is taken as a row direction and the direction in which the address electrodes 7 extend is taken as a column direction, the phosphors 3R, 3G and 3B are applied in the cell spaces 8 according to a given order among columns.

In the PDP 300, in order to secure an exhaust path for vacuum evacuation, the dielectric film 13 and the protective film 14 are raised on the bus electrodes 4X and 5Y above the remaining area. That is to say, the barrier ribs 2 extending in the row direction abut on the protective film 14 but the barrier ribs 2 extending in the column direction do not abut on the protective film 14. As a result, the cell spaces 8 are not perfectly closed and an exhaust path is thus ensured. The gap between the barrier ribs 2 and the protective film 14 shown in FIG. 22 illustrates this exhaust path.

A PDP having the structure shown in FIG. 20 is described in Video Information Media Society Journal Vol. 54, No.8, pp.1180 to 1184, for example.

In this conventional PDP 300 where all cell spaces 8 form discharge cells which adjoin each other, a discharge in a cell space 8 may induce other cell spaces 8 to cause erroneous discharges. For example, when there is a gap from the first between the edge of a barrier rib 2 and part of the front substrate 12 facing the barrier rib 2, or when a barrier rib 2 is cut or broken to form a gap during the manufacturing process of the PDP, charged particles under discharge may diffuse through the gap into adjacent cell spaces 8, possibly causing erroneous discharge over the barrier ribs 2.

Also, as shown in FIG. 22, the light produced in the cell space 8 includes light 21 which travels directly to the display surface and light 22 which penetrates into the barrier ribs 2 toward adjacent cell spaces 8. While the phosphors 3 have high reflectance and reflects light without loss, the barrier ribs 2 involve large loss of light. Accordingly the light 22 traveling toward adjacent cell spaces 8 is repeatedly reflected in the barrier ribs 2 and attenuated when taken out to the display surface. This causes the problem that, in the light produced in the cell space 8, the light traveling toward the adjacent cell spaces 8 cannot be effectively taken out onto the display surface.

SUMMARY OF THE INVENTION

A first aspect of the present invention is directed to a plasma display panel comprising: a first substrate forming a display surface; a second substrate placed to face the first substrate at a given distance; and barrier ribs sectioning a space between the first substrate and the second substrate into a plurality of independent cell spaces; wherein the plurality of cell spaces comprise a plurality of discharge cells and a plurality of non-discharge cells, and the plurality of discharge cells and the plurality of non-discharge cells are arranged so that each the discharge cell adjoins at least one the non-discharge cell.

Preferably, according to a second aspect of the present invention, in the plasma display panel of the first aspect, a phosphor is applied in the discharge cells and no phosphor is applied in the non-discharge cells.

Preferably, according to a third aspect of the present invention, the plasma display panel of the first aspect further comprises black insulating films provided on the second substrate in regions corresponding to the non-discharge cells.

Preferably, according to a fourth aspect of the present invention, the plasma display panel of the first aspect further comprises first reflection films provided on sides of the barrier ribs in regions corresponding to the non-discharge cells, and black insulating patterns provided on the first substrate in the regions corresponding to the non-discharge cells.

Preferably, according to a fifth aspect of the present invention, in the plasma display panel of the fourth aspect, the first reflection films are provided also on the second substrate in the regions corresponding to the non-discharge cells.

Preferably, according to a sixth aspect of the present invention, in the plasma display panel of the fourth or fifth aspect, the black insulating patterns on the first substrate are partially provided also in regions facing the barrier ribs.

Preferably, according to a seventh aspect of the present invention, in the plasma display panel of any of the fourth through sixth aspects, the first reflection films are formed of a phosphor.

Preferably, according to an eighth aspect of the present invention, the plasma display panel of any of the fourth through seventh aspects further comprises second reflection films provided on the black insulating patterns.

Preferably, according to a ninth aspect of the present invention, in the plasma display panel of the eighth aspect, the second reflection films are formed of a phosphor.

Preferably, according to a tenth aspect of the present invention, the plasma display panel of the first aspect further comprises: reflection films provided on sides of the barrier ribs in regions corresponding to the non-discharge cells; and black insulating films provided on the reflection films and on the second substrate in the regions corresponding to the non-discharge cells.

Preferably, according to an eleventh aspect of the present invention, the plasma display panel of the first aspect further comprises reflection films provided on sides of the barrier ribs in regions corresponding to the non-discharge cells and on the second substrate in the regions corresponding to the non-discharge cells, and black insulating films provided on the reflection films.

Preferably, according to a twelfth aspect of the present invention, in the plasma display panel of the tenth or eleventh aspect, the second reflection films are formed of a phosphor.

Preferably, according to a thirteenth aspect of the present invention, the plasma display panel of the first aspect further comprises sustain electrodes comprising first electrodes and second electrodes provided on the first substrate, wherein the first electrodes on the first substrate are arranged over the barrier ribs along a plurality of the discharge cells, and the second electrodes on the first substrate are arranged to protrude from the first electrodes only over the discharge cells.

Preferably, according to a fourteenth aspect of the present invention, in the plasma display panel of the thirteenth aspect, the first electrodes are arranged over the barrier ribs while being shifted toward the non-discharge cells.

Preferably, according to a fifteenth aspect of the present invention, in the plasma display panel of the first aspect, the barrier ribs comprise cuts formed in parts which face the first substrate, the cuts connecting adjacent the cell spaces.

Preferably, according to a sixteenth aspect of the present invention, in the plasma display panel of the first aspect, the first substrate comprises indentations formed in regions facing the barrier ribs, the indentations connecting adjacent the cell spaces.

Preferably, according to a seventeenth aspect of the present invention, in the plasma display panel of any of the first through sixteenth aspects, the discharge cells and the non-discharge cells are arranged in a matrix, and the discharge cells and the non-discharge cells are alternated horizontally and vertically.

Preferably, according to an eighteenth aspect of the present invention, in the plasma display panel of any of the first through seventeenth aspects, the discharge cells occupy a larger area in the display surface than the non-discharge cells.

A nineteenth aspect of the present invention is directed to a plasma display device comprising the plasma display panel of any of the first through eighteenth aspects.

According to the first aspect of the invention, the discharge cells do not adjoin each other, which suppresses and prevents erroneous discharge in discharge cells induced by discharge in other discharge cells.

According to the second aspect, since no phosphor is applied in the non-discharge cells, light traveling toward the non-discharge cells do not repeat reflection within the barrier ribs. Accordingly the light can be taken out to the display surface with smaller loss caused in the barrier ribs, thus providing improved luminous efficiency.

According to the third aspect, black insulating films are provided on the second substrate in regions corresponding to the non-discharge cells, which absorb external light such as room light coming from the display surface into the non-discharge cells. The external light reflected at the second substrate and taken out onto the display surface is thus attenuated, which enhances the bright room contrast.

According to the fourth aspect, reflection films are provided on the sides of the barrier ribs in regions corresponding to the non-discharge cells, so that light traveling toward the non-discharge cells travels in the barrier ribs and is taken out onto the display surface. The light thus do not spread and sharper image can be obtained.

Furthermore, black insulating patterns are provided on the first substrate in the regions corresponding to the non-discharge cells, which absorb external light such as room light coming from the display surface toward the non-discharge cells. The external light reflected at the second substrate and taken out onto the display surface is thus attenuated, which further improves the bright room contrast.

According to the fifth aspect, the reflection films are provided not only on the sides of the barrier ribs but also on the second substrate in the regions corresponding to the non-discharge cells, and the reflection films can be formed in a single process. This offers enhanced manufacturing efficiency.

According to the sixth aspect, the black insulating patterns are provided not only on the first substrate in the regions corresponding to the non-discharge cells but also partially on the first substrate in regions facing the barrier ribs. Therefore the black parts occupy a larger area seen from the display surface. A larger amount of external light can thus be absorbed to further enhance the bright room contrast.

According to the seventh aspect, since the first reflection films are formed of a phosphor, for example if the phosphor applied in the discharge cells and the phosphor of the first reflection films are made of the same material, the material cost can be reduced.

According to the eighth aspect, reflection films are provided on the black insulating patterns, so that light entering the non-discharge cells can be taken out onto the display surface without being absorbed by the black insulating patterns. This further enhances the luminous efficiency.

According to the ninth aspect, since the second reflection films are formed of a phosphor, for example if the phosphor applied in the discharge cells and the phosphor of the first and second reflection films are made of the same material, the material cost can be reduced.

According to the tenth aspect, reflection films are provided on the sides of the barrier ribs in the regions corresponding to the non-discharge cells and black insulating films are provided on the reflection films and on the second substrate in the regions corresponding to the non-discharge cells. Sharper image can be obtained and the bright room contrast can be further enhanced with a structure different from that of the fourth aspect.

According to the eleventh aspect, the reflection films are provided not only on the sides of the barrier ribs but also on the second substrate in the regions corresponding to the non-discharge cells, and the reflection films can be formed in a single process. This further enhances the manufacturing efficiency.

According to the twelfth aspect, since the reflection films are formed of a phosphor, for example if the phosphor applied in the discharge cells and the phosphor of the reflection films are made of the same material, the material cost can be reduced.

According to the thirteenth aspect, the first electrodes are arranged on the first substrate over the barrier ribs along a plurality of discharge cells, so that the light produced from the phosphor can be taken out onto the display surface without being blocked by the first electrodes. This enhances the luminous efficiency.

According to the fourteenth aspect, the first electrodes arranged over the barrier ribs are shifted toward the non-discharge cells. Accordingly, even if a slight positional error occurs in bonding the first substrate and the second substrate together, the first electrodes will not extend over the discharge cell regions. This allows the precision in relatively positioning the first substrate and the second substrate to be relaxed, further effectively preventing reduction in emission luminance.

According to the fifteenth aspect, the barrier ribs have cuts formed in parts which face the first substrate to connect adjacent cell spaces, so that the gap area between the barrier ribs and the protective film can be smaller. It is then possible to prevent charged particles produced by discharge in the discharge cells from spreading into adjacent cell spaces, so as to suppress and prevent erroneous discharge in other discharge cells.

According to the sixteenth aspect, the first substrate has indentations formed in parts which face the barrier ribs to connect adjacent cell spaces. An exhaust path for vacuum evacuation can thus be ensured with a structure different from that of the fifteenth aspect.

According to the seventeenth aspect, the discharge cells and the non-discharge cells are arranged in a matrix and the discharge cells and the non-discharge cells are alternately arranged in length and width directions. Accordingly a larger number of non-discharge cells adjoin the discharge cells. It is thus possible to take out a larger amount of light onto the display surface with smaller loss caused in the barrier ribs, which further enhances the luminous efficiency.

According to the eighteenth aspect, the discharge cells occupy a larger area in the display surface than the non-discharge cells. A larger area can thus contribute to image display and the display area can be used more efficiently.

According to the nineteenth aspect, a plasma display device has the plasma display panel of any one of the first to eighteenth aspects. A plasma display device having any one of the effects of the first to eighteenth aspects can thus be obtained.

The present invention has been made to solve the problems mentioned earlier, and an object of the present invention is to provide a PDP with improved luminous efficiency which can prevent erroneous discharge in adjacent cell spaces 8 and which can effectively take out light produced in the cell spaces 8, and a plasma display device having that PDP.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
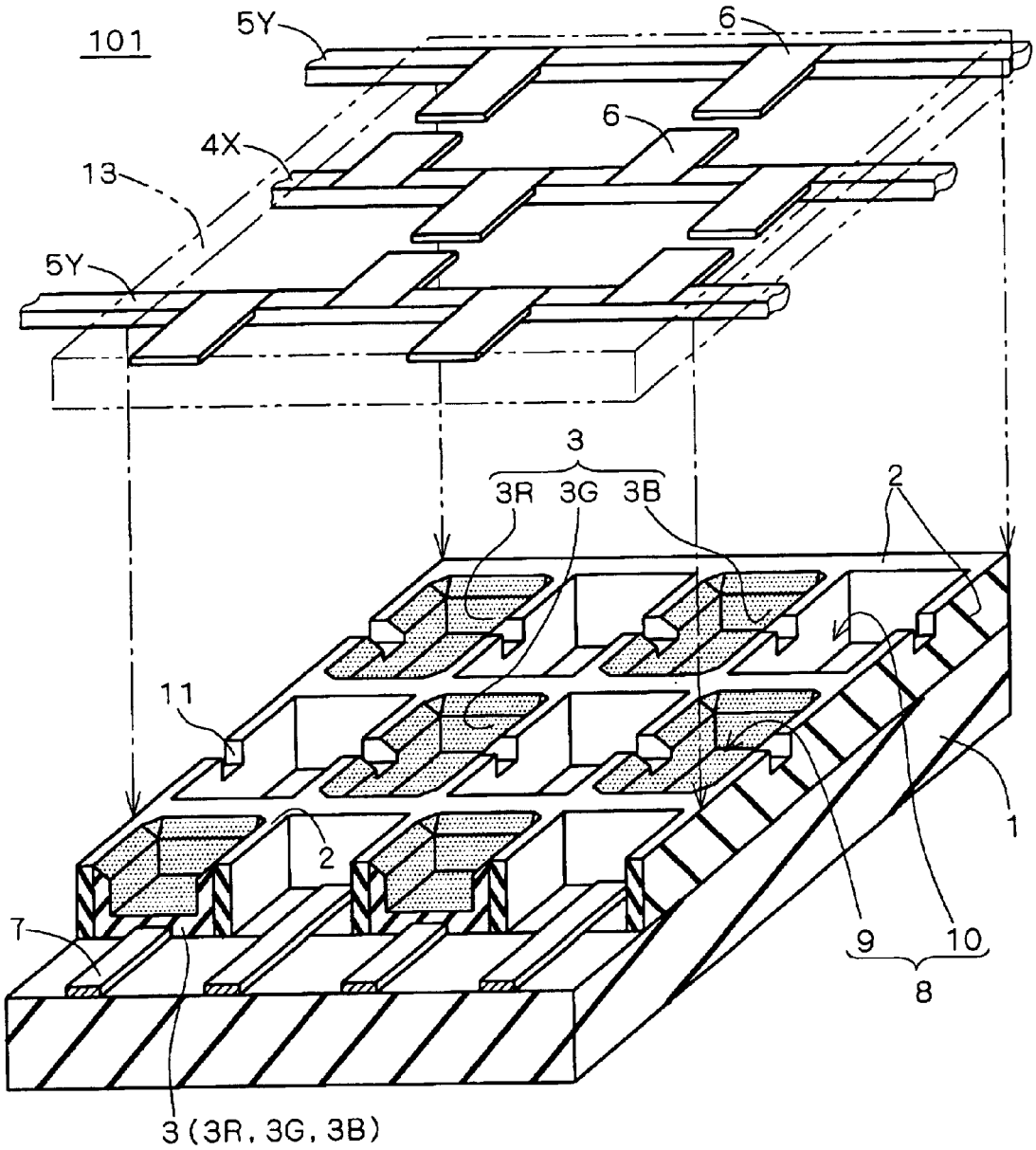
FIG. 1 is a perspective view schematically showing the structure of a PDP according to a first preferred embodiment.

FIG. 1 is a perspective view schematically showing the structure of a PDP 101 according to a first preferred embodiment. While the bus electrodes 4X, the bus electrodes 5Y, and the transparent electrodes 6 are formed on the side of a front substrate which faces the back substrate 1 in parallel, FIG. 1 does not show the front substrate in the PDP 101 since it does not characteristically differ from the conventional structure. Also in FIG. 1, in order to show the configuration of the transparent electrodes 6 etc., a dielectric film formed on the front substrate to cover the bus electrodes 4X, 5Y and the transparent electrodes 6 and a protective film formed on the dielectric film are shown with two-dot chain lines as a dielectric film 13 including the protective film. A thick film of a low melting point glass is used as the dielectric film 13 formed on the front substrate and a deposited film of MgO (magnesium oxide) is used as the protective film, for example. Since FIG. 1 does not show the front substrate, and for convenience of explanation, FIG. 1 shows the bus electrodes 4X, 5Y and the transparent electrodes 6 separated from the barrier ribs 2. In effect, the front substrate is placed so that the edges of the barrier ribs 2 abut on the protective film formed on the front substrate.

The bus electrodes 4X and the bus electrodes 5Y are alternately disposed on the front substrate forming the display surface (not shown). Address electrodes 7, three-dimensionally intersecting with the bus electrodes 4X and 5Y, are disposed on the back substrate 1. The front substrate and the back substrate 1 are disposed in parallel opposite each other at a given distance. The space between the front substrate and the back substrate 1 is sectioned into a plurality of cell spaces 8 by the grid-like barrier ribs 2 formed on the back substrate 1. The bus electrodes 4X and 5Y are disposed along the barrier ribs 2 and overlap the barrier ribs 2. The address electrodes 7 are placed approximately in the middle of the cell spaces 8. The cell spaces 8 include discharge cells 9 in which discharge occurs and non-discharge cells 10 in which discharge does not occur; the discharge cells 9 and the non-discharge cells 10 are alternated horizontally and vertically (in alternate checkers). While FIG. 1 shows the barrier ribs 2 formed directly on the back substrate 1, the barrier ribs 2 may be formed on a dielectric layer formed on the back substrate 1. The barrier ribs 2 can be formed by a conventional sandblasting process.

Each transparent electrode 6 has its one end connected to a bus electrode 4X or 5Y and is disposed to protrude from the connection over the discharge cell 9. The transparent electrodes 6 are formed only over the discharge cells 9; they are not formed over the non-discharge cells 10. The bus electrodes 4X and SY and the transparent electrodes 6 are called sustain electrodes together. The transparent electrodes 6 extending from the bus electrodes 4X and the transparent electrodes 6 extending from the bus electrodes SY form pairs to produce given discharges. The dielectric film 13 (including a protective film) is formed to cover the bus electrodes 4X, the bus electrodes 5Y, and the transparent electrodes 6.

The transparent electrodes 6 are formed of an ITO film (an alloy oxide film of indium and tin), for example. Since the transparent electrodes 6 formed of ITO film do not have sufficient electric conductivity, the bus electrodes 4X and 5Y having superior conductivity to the transparent electrodes 6 are formed to reduce the total impedance. The bus electrodes 4X and 5Y are formed of a metal having good conductivity, e.g. silver, and they are therefore generally opaque. Although the first preferred embodiment uses the transparent electrodes 6 extending over the discharge cells 9 to produce given discharge in pairs, they may be formed by using the same material as the bus electrodes 4X and 5Y. That is to say, electrodes extending over the discharge cells 9 and the bus electrodes 4X and 5Y may be formed integrally. The material of the bus electrodes 4X and 5Y is generally opaque as stated above. Accordingly, in this case, when the electrodes are formed in the same shape as the transparent electrodes 6, the opaque electrodes block the light produced in the discharge cells 9, reducing the luminous efficiency. Therefore, when the electrodes extending over the discharge cells 9 are formed of the same material as the bus electrodes 4X and 5Y and in the same shape as the transparent electrodes 6, each electrode is shaped in a frame-like shape with an opening formed in the center, so that light can be taken out through the opening.

As shown in FIG. 1, the discharge cells 9 and the non-discharge cells 10 are each surrounded and formed by the back substrate 1, barrier ribs 2, and front substrate (not shown). A phosphor 3R for red (R) emission, a phosphor 3G for green (G) emission, or a phosphor 3B for blue (B) emission (referred to also as "phosphors 3" together) is applied in the discharge cells 9; the phosphors 3 are not applied in the non-discharge cells 10. More specifically, the phosphors 3 are applied on the back substrate 1 in the regions which correspond to the discharge cells 9 and on the side surfaces of the barrier ribs 2 which correspond to the discharge cells 9. When the direction in which the bus electrodes 4X and 5Y extend is taken as a row direction and the direction in which the address electrodes 7 extend is taken as a column direction, the phosphors 3R, 3G and 3B are applied in the discharge cells 9 arranged in given columns, and in every other cell in each column. The phosphors 3 can be applied by a conventional screen printing process.

Since each discharge cell 9 in the PDP 101 is surrounded by the barrier ribs 2 along the entire periphery, an exhaust path is needed for vacuum evacuation. Cuts 11 for enabling the vacuum evacuation are formed in the edges of the barrier ribs 2 (in the parts facing the front substrate not shown); the cuts 11 are positioned so that they do not overlap the bus electrodes 4X and 5Y. That is to say, in FIG. 1, the cuts 11 are formed in the edges of the barrier ribs 2 which extend in the column direction to connect the adjacent cell spaces 8. It is desired that the cuts 11 are formed to a minimum depth required for vacuum evacuation, so as to reduce the amount of the phosphors 3 flowing through the cuts 11 into adjacent cell spaces 8 during application of the phosphors 3 to the discharge cells 9. While the cuts 11 in the PDP 101 are disposed so that they do not overlap the bus electrodes 4X and 5Y, they may be formed to overlap the bus electrodes 4X and 5Y, i.e. in the edges of the barrier ribs 2 which extend in the row direction in FIG. 1.

Figure 2:
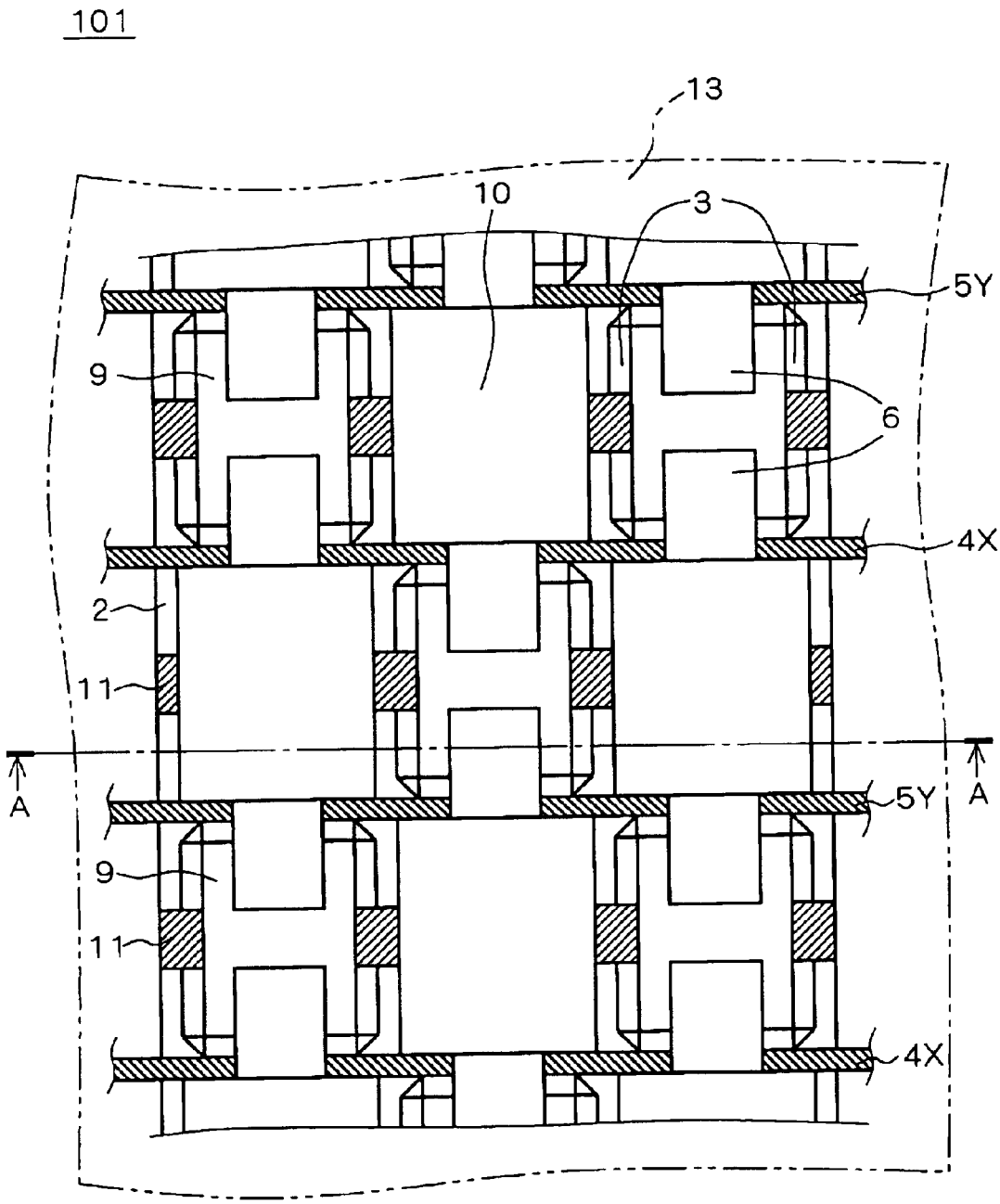
FIG. 2 is a plan view schematically showing the structure of the PDP of the first preferred embodiment.
Figure 3:
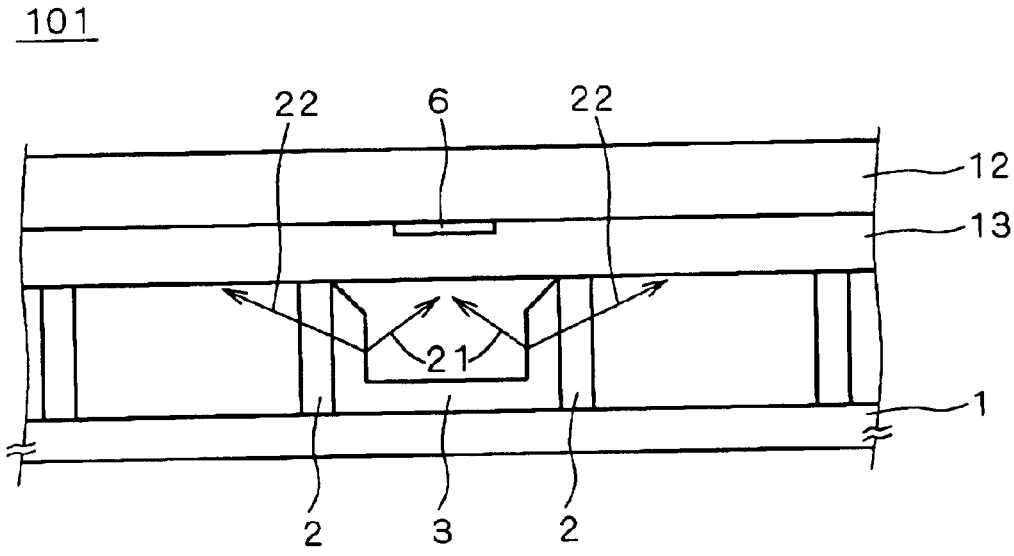
FIG. 3 is a sectional view schematically showing the structure of the PDP of the first preferred embodiment.

FIG. 2 is a plan view schematically showing the structure of the PDP 101 having the structure described above; for convenience of explanation, FIG. 2 does not show the front substrate and the address electrodes 7. FIG. 3 is a sectional view schematically showing the structure of the PDP 101 taken along the line A—A in FIG. 2, which additionally shows the front substrate 12 not shown in FIG. 2. FIG. 3 does not show the address electrodes 7. This applies also to the second and other preferred embodiments described later. As shown in FIG. 3, the phosphors 3 are not applied in the non-discharge cells 10, so that the light 22 traveling into the non-discharge cells 10 does not repeat reflection in the barrier ribs 2.

As explained so far, according to the PDP 101 of the first preferred embodiment, the non-discharge cells 10 are disposed next to the discharge cells 9, so that the discharge cells 9 do not adjoin each other. As compared with the conventional PDP 300, this structure more effectively suppresses and prevents erroneous discharge in discharge cells 9 induced by discharge in other discharge cells 9.

Also, since the light 22 traveling toward the non-discharge cells 10 is not repeatedly reflected in the barrier ribs 2, the light 22 suffering smaller loss in the barrier ribs 2 can be taken out onto the display surface, which enhances the luminous efficiency of the PDP 101.

Furthermore, since the bus electrodes 4X and 5Y having lower transmittance than the transparent electrodes 6 are disposed to lie over the barrier ribs 2, the lights 21 and 22 produced from the phosphors 3 can be taken out onto the display surface without being blocked by the bus electrodes 4X and 5Y. This further enhances the luminous efficiency of the PDP 101.

In the conventional PDP 300, a gap is formed between the barrier ribs 2 extending in the column direction and the protective film 14 to secure an exhaust path for vacuum evacuation. On the other hand, in the PDP 101, the cuts 11 are formed in the edges of the barrier ribs 2 as an exhaust path for vacuum evacuation. That is to say, the barrier ribs 2 in the PDP 101 form gaps with the protective film only at the edges having the cuts 11. The gap area between the barrier ribs 2 and the protective film is thus smaller than that in the PDP 300. This makes it possible to prevent charged particles produced by discharge in the discharge cells 9 from spreading into adjacent cell spaces 8, thus further suppressing and preventing erroneous discharge in the adjacent cell spaces 8.

Under the condition that the discharge cells 9 and the non-discharge cells 10 are disposed so that the non-discharge cells 10 reside next to the discharge cells 9, the feature that the phosphors 3 are not applied to the non-discharge cells 10, the feature that the bus electrodes 4X and 5Y are disposed along and over the barrier ribs 2, and the feature that the cuts 11 for vacuum evacuation are formed in the edges of the barrier ribs 2, have their respective independent effects. A PDP having any one of the features provides the above-described effect owing to the feature.

Second Preferred Embodiment

Figure 4:
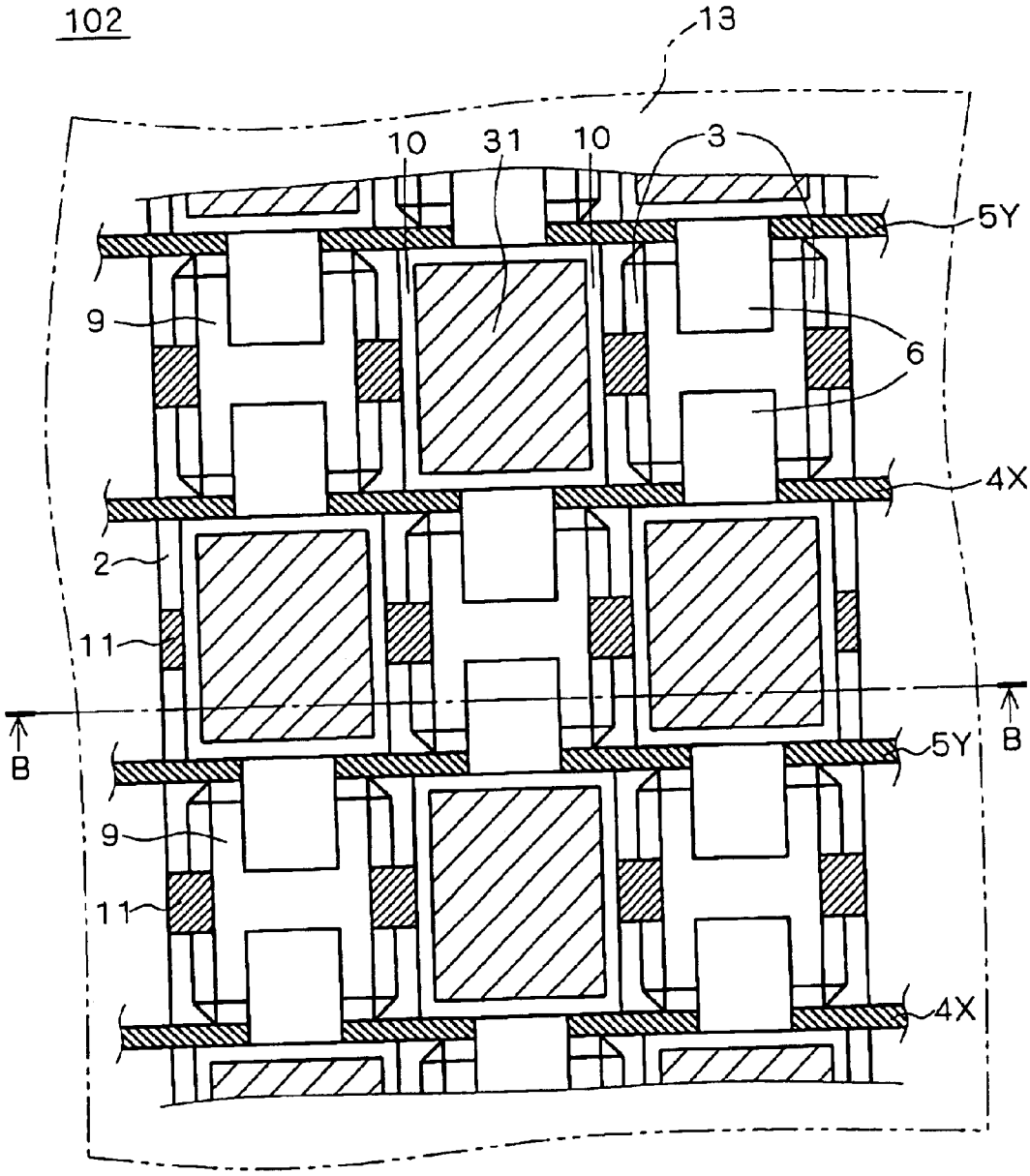
FIG. 4 is a plan view schematically showing the structure of a PDP according to a second preferred embodiment.
Figure 5:
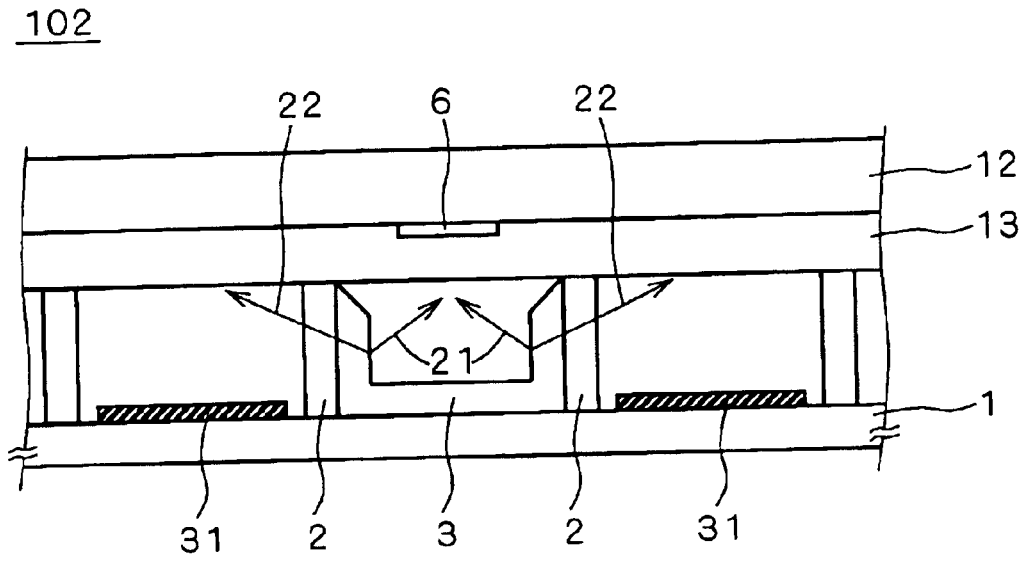
FIG. 5 is a sectional view schematically showing the structure of the PDP of the second preferred embodiment.

FIG. 4 is a plan view schematically showing the structure of a PDP 102 according to a second preferred embodiment and FIG. 5 is a sectional view schematically showing the structure of the PDP 102 taken along the line B—B in FIG. 4. As shown in FIGS. 4 and 5, in the PDP 102, black insulating films 31 are formed on the back substrate 1 in the areas corresponding to the non-discharge cells 10 shown in the PDP 101 of the first preferred embodiment. The black insulating films 31 are formed by printing a glass paste containing a black material such as iron oxide or chromium oxide. Alternatively, they may be formed by printing a black glass paste containing a photosensitive polymer and exposing and developing it with a photomask to form a pattern. In other respects the structure is the same as that of the PDP 101 and not described again.

As described above, the PDP 102 of the second preferred embodiment offers the following effect in addition to the effects of the PDP 101 of the first preferred embodiment. That is to say, the black insulating films 31 absorb external light like room light incident from the display surface into the non-discharge cells 10. The external light reflected at the back substrate 1 and taken out to the display surface is therefore attenuated, which enhances the bright room contrast as compared with the PDP 101.

Third Preferred Embodiment

Figure 6:
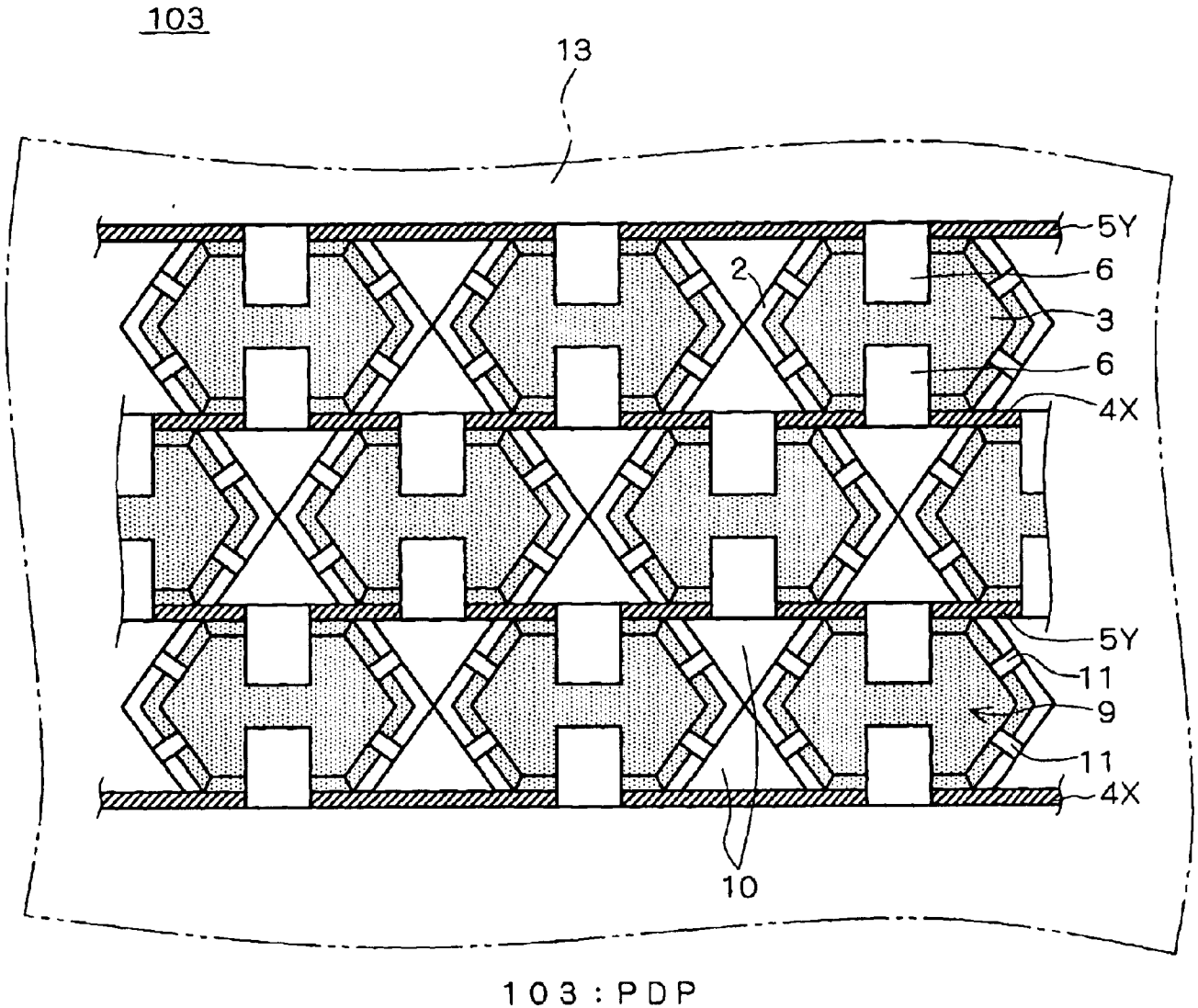
FIG. 6 is a plan view schematically showing the structure of a PDP according to a third preferred embodiment.

FIG. 6 is a plan view schematically showing the structure of a PDP 103 according to a third preferred embodiment. In the PDP 103, the discharge cells 9 in the above-described PDP 101 are formed in hexagons. That is to say, among the barrier ribs 2 in the PDP 101, the barrier ribs 2 which form the discharge cells 9 and which do not overlap the bus electrodes 4X and 5Y are protruded in the center toward the non-discharge cells 10; each discharge cell 9 thus forms a hexagon. As a result, the discharge cells 9 are larger than the non-discharge cells 10 when the PDP 103 is seen from the display surface. That is to say, the area of the discharge cells 9 in the display surface is larger than that of the non-discharge cells 10. In other respects the structure is the same as that of the PDP 101 and not described again.

As shown above, the PDP 103 of the third preferred embodiment offers the following effect in addition to the effects of the PDP 101 of the first preferred embodiment. That is to say, the area of the region which contributes to image display can be larger than in the PDP 101 having the same panel area and the same resolution. The efficiency of use of the display area can thus be enhanced as compared with the PDP 101 in which the discharge cells 9 and the non-discharge cells 10 are equal in area in the display surface.

Although each discharge cell 9 is formed in the shape of a hexagon in the PDP 103, the structure of this invention is not limited to this. Needless to say, the same effect as that of the PDP 103 can be obtained also when the discharge cells 9 are formed in polygonal shape other than hexagons, and also when the discharge cells 9 are formed in barrel-like shape; that is, the barrier ribs 2 which do not overlap the bus electrodes 4X and 5Y in the PDP 101 may be swelled toward the non-discharge cells 10 to draw circular arcs.

Also, the bright room contrast can be enhanced by providing, as in the PDP 102, the black insulating films 31 in the non-discharge cells 10 in the PDP 103.

Fourth Preferred Embodiment

Figure 7:
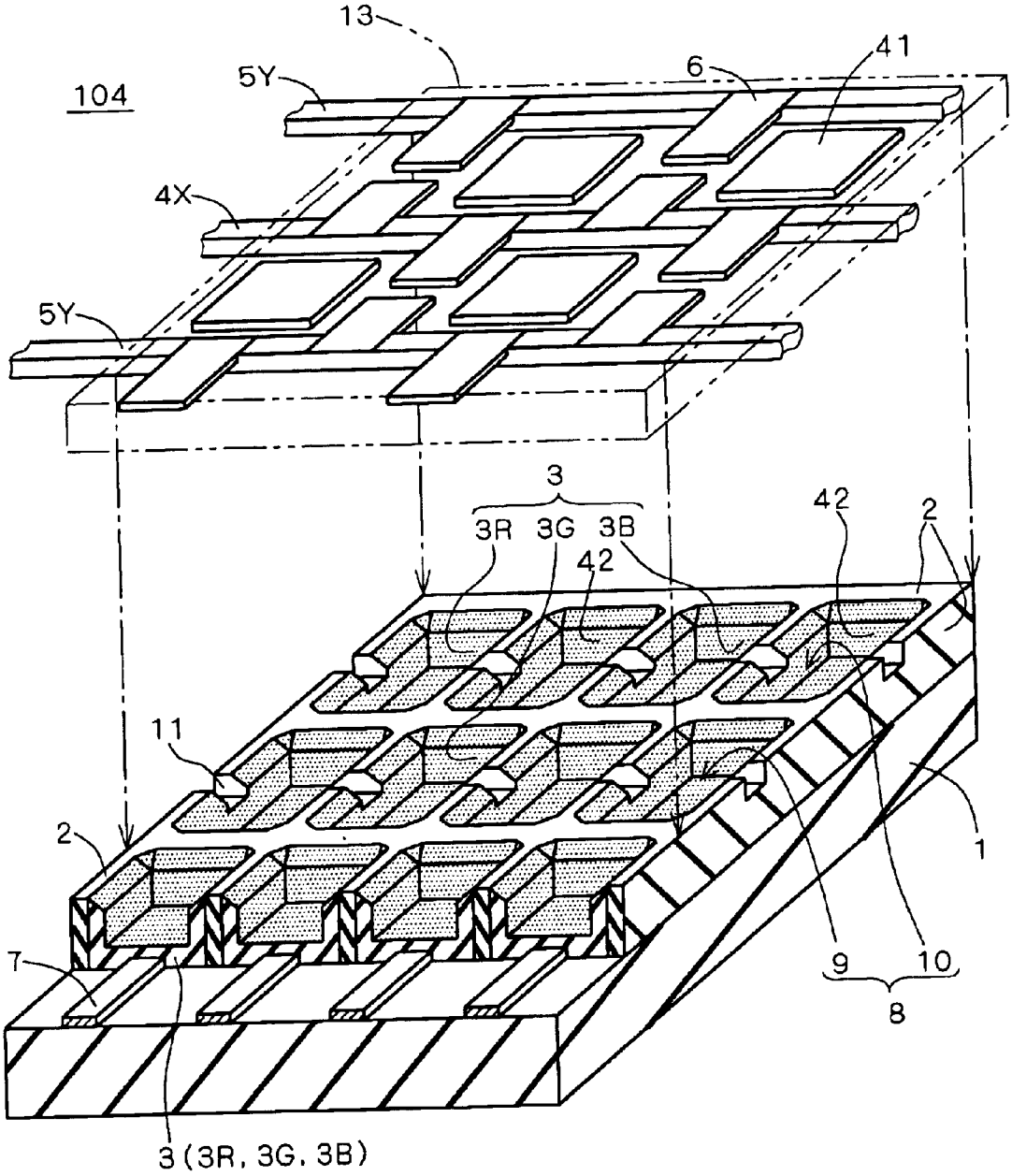
FIG. 7 is a perspective view schematically showing the structure of a PDP according to a fourth preferred embodiment.

FIG. 7 is a perspective view schematically showing the structure of a PDP 104 according to a fourth preferred embodiment, which, like FIG. 1 used to describe the PDP 101, does not show the front substrate and shows the dielectric film 13 (including the protective film) with two-dot chain lines. Also, like FIG. 1, FIG. 7 shows the bus electrodes 4X and 5Y and the transparent electrodes 6 separated from the barrier ribs 2.

Black insulating patterns 41 are formed on the front substrate (not shown) in the regions corresponding to the non-discharge cells 10. The black insulating patterns 41 are formed by printing a glass paste containing a black material such as iron oxide or chromium oxide. Alternatively it may be formed as a pattern by printing a black glass paste containing a photosensitive polymer and exposing and developing it with a photomask. White reflection films 42 are formed on the back substrate 1 and the side surfaces of the barrier ribs 2 which form the non-discharge cells 10. For example, the reflection films 42 are formed by: mixing powder formed of fine particles of titanium oxide, or powder formed of $SiO_2$, $Al_2O_3$, $ZrO_2$, etc., with a vehicle and a flux to produce a printing paste; applying the printing paste by screen printing and drying it to form a powder film on the back substrate 1 and the sides of the barrier ribs 2; and firing the resin contained in the vehicle to form the reflection films 42. During the application by screen printing, the printing paste of the reflective material leaks into the discharge cells 9 through the cuts 11. However, when the printing paste is applied before application of the phosphors 3 in the discharge cells 9, the reflective material does not cover the phosphors 3 and not hinder light emission from the phosphors 3. In other respects the structure is the same as that of the PDP 101 and not described again.

Figure 8:
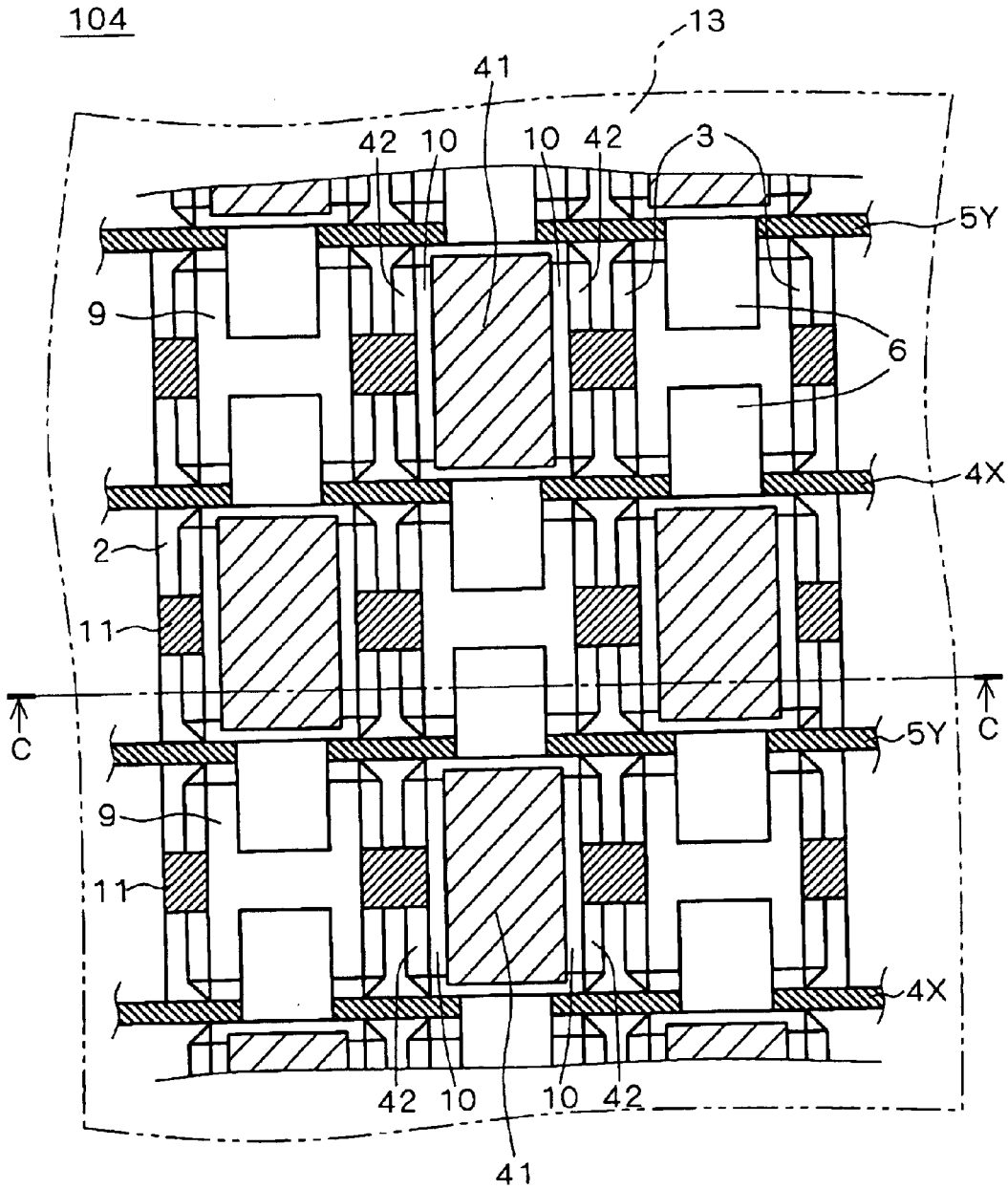
FIG. 8 is a plan view schematically showing the structure of the PDP of the fourth preferred embodiment.
Figure 9:
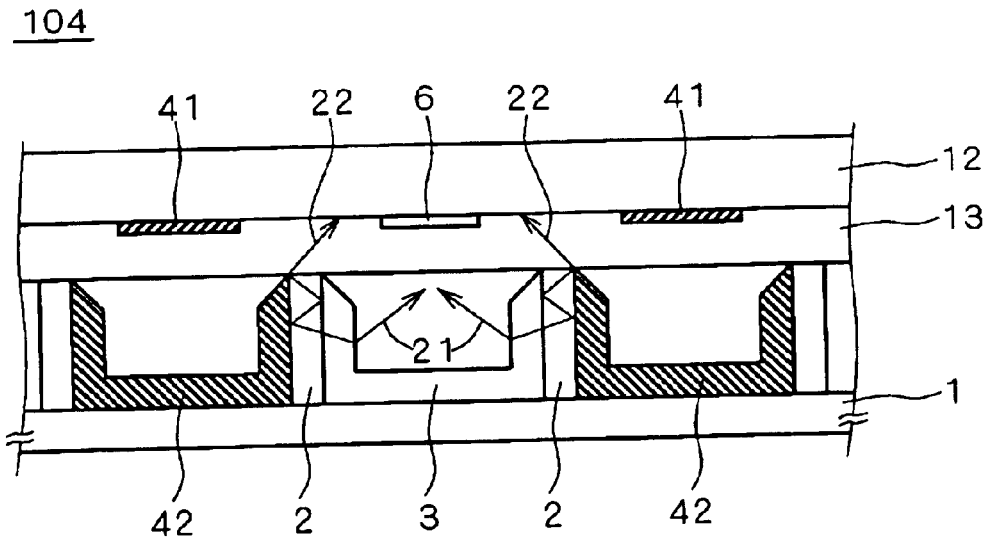
FIG. 9 is a sectional view schematically showing the structure of the PDP of the fourth preferred embodiment.

FIG. 8 is a plan view schematically showing the structure of the PDP 104 having the structure shown above, and FIG. 9 is a sectional view schematically showing the structure of the PDP 104 taken along the line C—C in FIG. 8. In the PDP 101 described earlier, in order to enhance the luminous efficiency, a material which reflects light, such as the phosphors 3, is not applied in the non-discharge cells 10. However, although this enhances the luminous efficiency, the light greatly spreads since the light 22 produced from the phosphor 3 is taken out from the adjacent cell spaces 8 onto the display surface, and therefore sharp image cannot be obtained. In the PDP 104, since the reflection films 42 are formed in the non-discharge cells 10 as shown in FIG. 9, the light 22 traveling toward the non-discharge cells 10 repeats reflection between the reflection film 42 and the phosphor 3 and is taken out through the barrier ribs 2 onto the display surface.

In this way, in the PDP 104 of the fourth preferred embodiment, although the luminous efficiency is lower than in the PDP 101, the light does not spread since the light 22 traveling toward the non-discharge cells 10 is taken out onto the display surface through the barrier ribs 2, and therefore sharper image can be obtained than in the PDP 101.

Also, external light such as room light incident on the non-discharge cells 10 from the display surface is absorbed by the black insulating patterns 41. External light reflected at the back substrate 1 and taken out onto the display surface is thus attenuated and the bright room contrast can be enhanced, as compared with that in the absence of the black insulating patterns 41.

Figure 10:
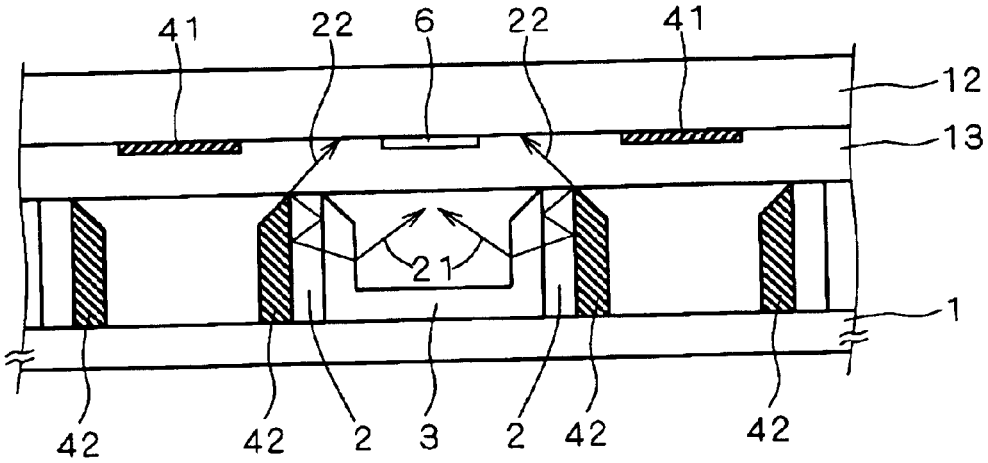
FIG. 10 is a sectional view schematically showing the structure of a PDP according to a variation of the fourth preferred embodiment.

FIG. 10 is a sectional view schematically showing the structure of a PDP 204 which is a variation of the PDP 104. The plan view of the PDP 204 is the same as that schematically shown in FIG. 8 and FIG. 10 is a sectional view taken along the line C—C in FIG. 8. While the reflection films 42 are formed on the back substrate 1 and the sides of the barrier ribs 2 in the PDP 104, the same effect can be obtained when the reflection films 42 on the back substrate 1 are removed by a sandblasting process, leaving the reflection films 42 only on the sides of the barrier ribs 2 as shown in the PDP 204 of FIG. 10.

When the manufacturing process of the PDP 104 and that of the PDP 204 are considered, the PDP 104 can be more efficiently manufactured than the PDP 204 since the PDP 204 requires the process of removing the reflection films 42 on the back substrate 1 by a sandblasting process.

Fifth Preferred Embodiment

Figure 11:
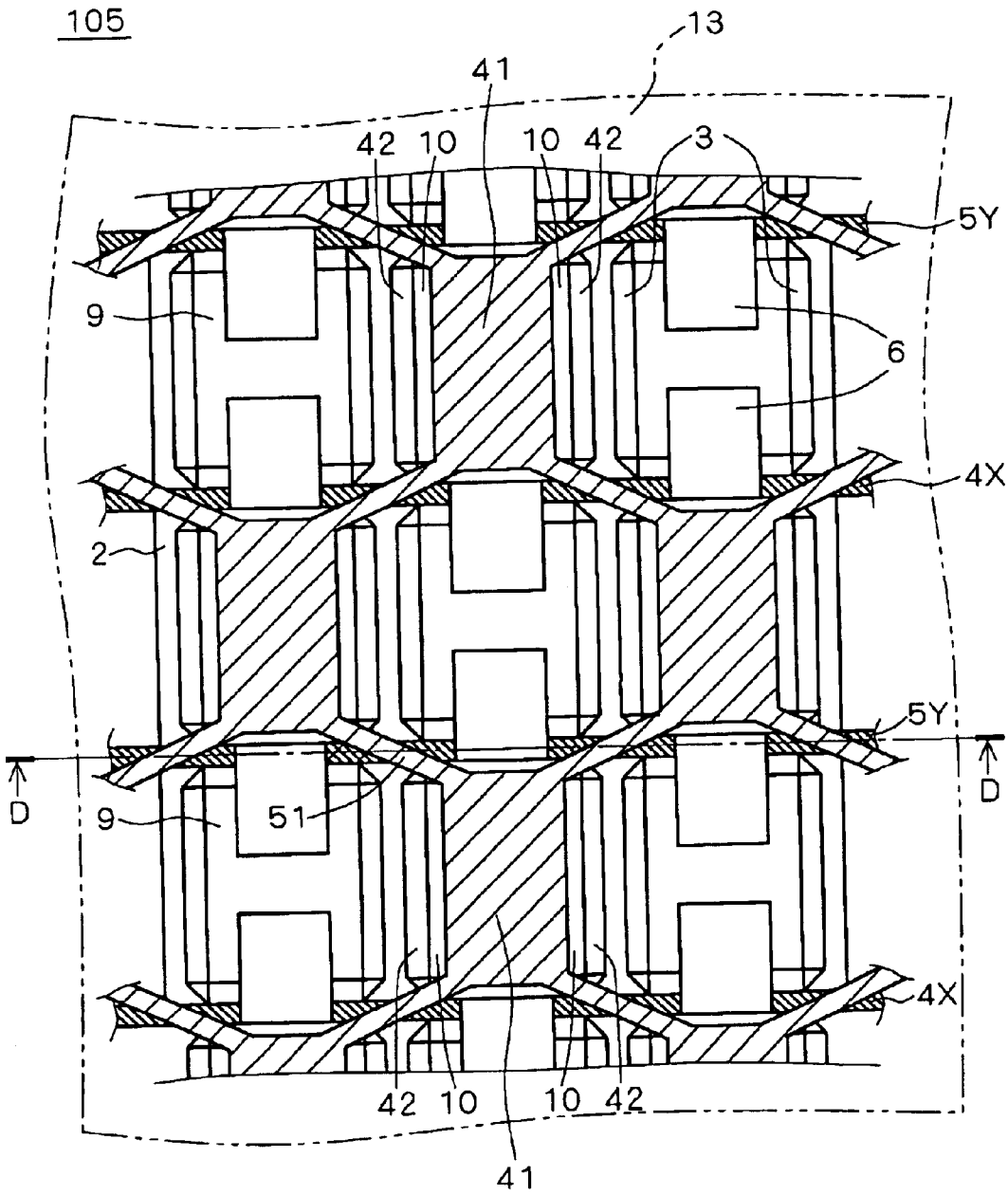
FIG. 11 is a plan view schematically showing the structure of a PDP according to a fifth preferred embodiment.
Figure 12:
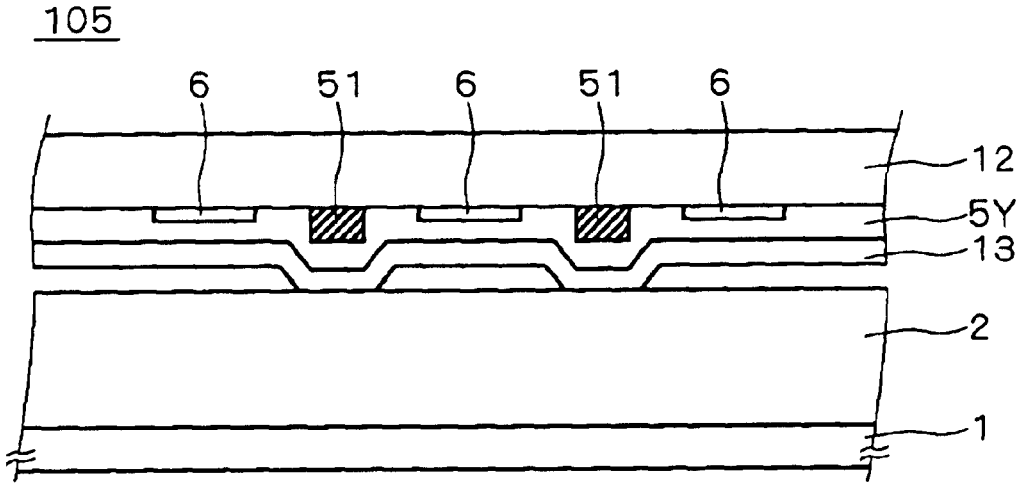
FIG. 12 is a sectional view schematically showing the structure of the PDP of the fifth preferred embodiment.

FIG. 11 is a plan view schematically showing the structure of a PDP 105 according to a fifth preferred embodiment and FIG. 12 is a sectional view schematically showing the structure of the PDP 105 taken along the line D—D in FIG. 11. In the PDP 105, as shown in FIGS. 11 and 12, the black insulating patterns 41 in the PDP 104 are connected to each other. More specifically, the black insulating patterns 41 disposed over the regions corresponding to the non-discharge cells 10 are connected by black insulating patterns 51; the black insulating patterns 51 are provided on the front substrate 12 in the regions facing the barrier ribs so that they do not block light produced in the discharge cells 9. The bus electrodes 4X and 5Y are formed on the front substrate 12, on which the black insulating patterns 41 and 51 are formed, and the dielectric film 13 is formed to cover the black insulating patterns 41 and 51, the bus electrodes 4X and 5Y, and the transparent electrodes 6. While the cuts 11 are formed in the edges of the barrier ribs 2 in the PDP 104, it is not necessary in the PDP 105 to form the cuts 11 in the edges of the barrier ribs 2, as will be described later. Therefore FIG. 11 does not show the cuts 11. In other respects the structure is the same as that of the PDP 104 and not described again.

In the PDP 104, since the black insulating patterns 41 on the front substrate 12 are arranged only in the regions corresponding to the non-discharge cells 10, the dielectric film 13 is not raised in the regions which face the barrier ribs 2. Accordingly, in the absence of the cuts 11, the edges of the barrier ribs 2 entirely abut on the dielectric film 13 and the discharge cells 9 and the non-discharge cells 10 are surrounded and completely closed by the back substrate 1, the front substrate 12 and the barrier ribs; then an exhaust path for vacuum evacuation cannot be secured. However, in the PDP 105, the exhaust path can be ensured even in the absence of the cuts 11. That is to say, the black insulating patterns 51 on the front substrate 12 are disposed also in the regions which face the barrier ribs 2. Accordingly, in the regions facing the barrier ribs 2, the dielectric film 13 is raised in the regions where the black insulating patterns 51 are present, above the regions where the black insulating patterns 51 are absent, and the barrier ribs 2 abut on the dielectric film 13 in the raised parts. The discharge cells 9 and the non-discharge cells 10 are therefore not completely closed and an exhaust path is ensured. The black insulating patterns 41 and 51 are made of a thick film of 5 to 10 $\mu$m in thickness and the dielectric film 13 is raised by 2 to 5 $\mu$m on the black insulating patterns 51.

In the PDP 104, the cuts 11 are formed, after formation of the barrier ribs 2, by removing given parts of the barrier ribs 2 by a sandblasting process etc. On the other hand, in the PDP 105, the black insulating patterns 51 can be formed together with the black insulating patterns 41, without requiring a separate process for forming the black insulating patterns 51. The PDP 105 which does not have the cuts 11 can thus be manufactured by a less number of manufacturing process steps than the PDP 104 having the cuts 11.

In this way, the PDP 105 of the fifth preferred embodiment further comprises the black insulating patterns 51 connecting the black insulating patterns 41 provided over the non-discharge cells 10, so that the black area seen from the display surface is larger than that in the PDP 104. A larger amount of external light can thus be absorbed and the bright room contrast can be enhanced than in the PDP 104.

Also, the PDP 105 can be manufactured by a less number of process steps than the PDP 104, offering superior manufacturing efficiency to the PDP 104.

In the PDP 105, the black insulating patterns 51 are arranged on the front substrate 12 only in the regions corresponding to the intersections of the barrier ribs 2, and the black insulating patterns 41 corresponding to the non-discharge cells 10 are connected by the black insulating patterns 51. However, the effect of this invention is not limited to this structure. More specifically, it works as long as the black insulating patterns 51 are arranged on the front substrate 12 partially in the regions which face the barrier ribs 2; the location and the area of the black insulating patterns 51 are not limited to the structure in the PDP 105. Further, it is not essential, in order to obtain the effect, that the black insulating patterns 41 be connected to each other. However, a PDP, like the PDP 105, in which the black insulating patterns 51 are arranged on the front substrate 12 only in the regions corresponding to the intersections of the barrier ribs 2 offers better mechanical strength than a PDP in which the black insulating patterns 51 are arranged in regions other than the intersections of the barrier ribs 2. More specifically, in order to maintain the cell spaces 8 formed between the front substrate 12 and the back substrate 1, the barrier ribs 2 are required to provide mechanical strength enough to withstand given stress applied from the front substrate 12 and the back substrate 1. In the PDP 105, the barrier ribs 2 suffer larger stress than those in the PDP 104, since the barrier ribs 2 and the dielectric film 13 abut on each other in a smaller area. Since the black insulating patterns 51 in the PDP 105 are arranged so that the barrier ribs 2 and the dielectric film 13 abut on each other only on the mechanically stronger intersections, the PDP 105 offers superior mechanical strength to a PDP in which the black insulating patterns 51 are arranged in regions other than the intersections of the barrier ribs 2.

Sixth Preferred Embodiment

Figure 13:
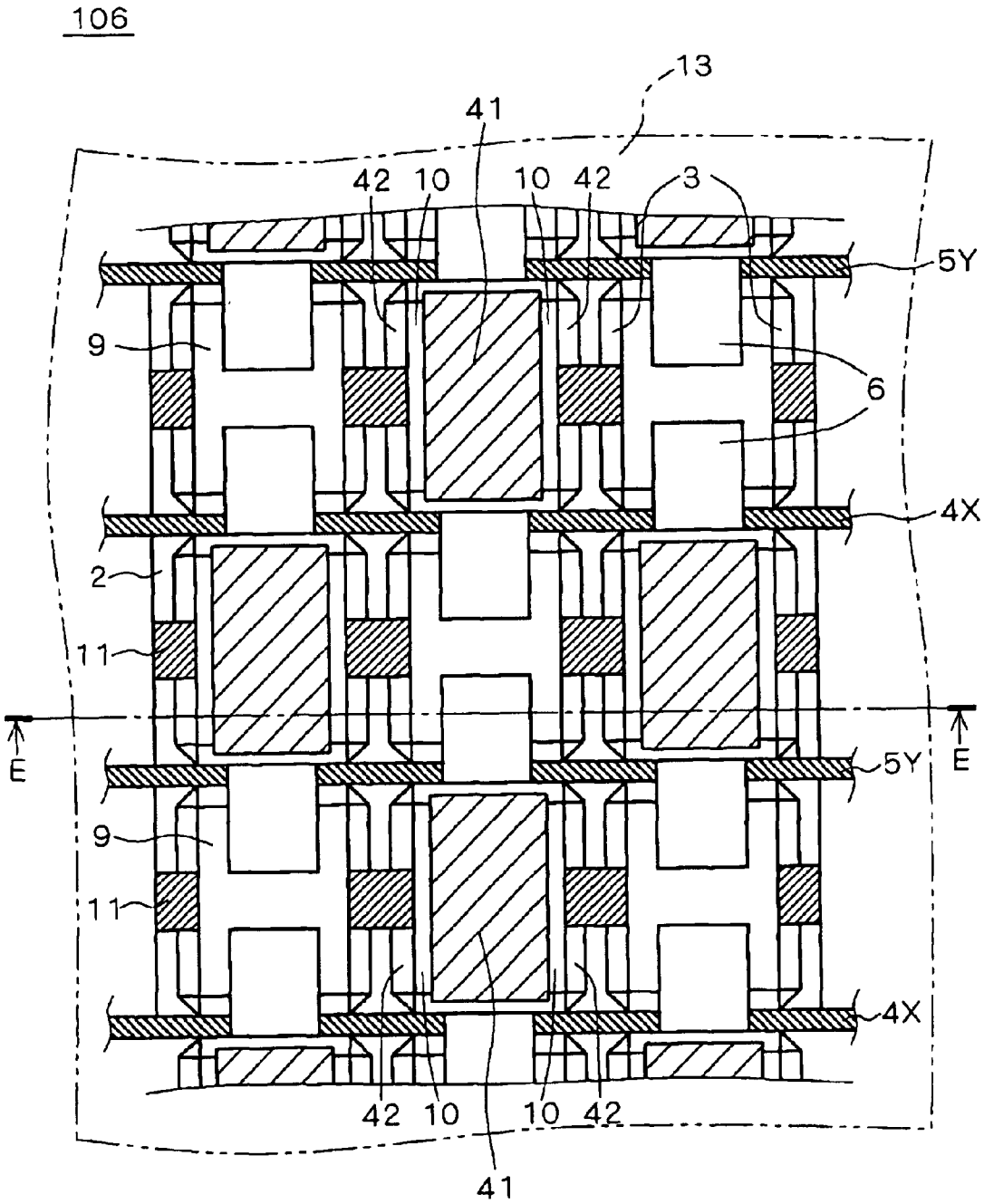
FIG. 13 is a plan view schematically showing the structure of a PDP according to a sixth preferred embodiment.
Figure 14:
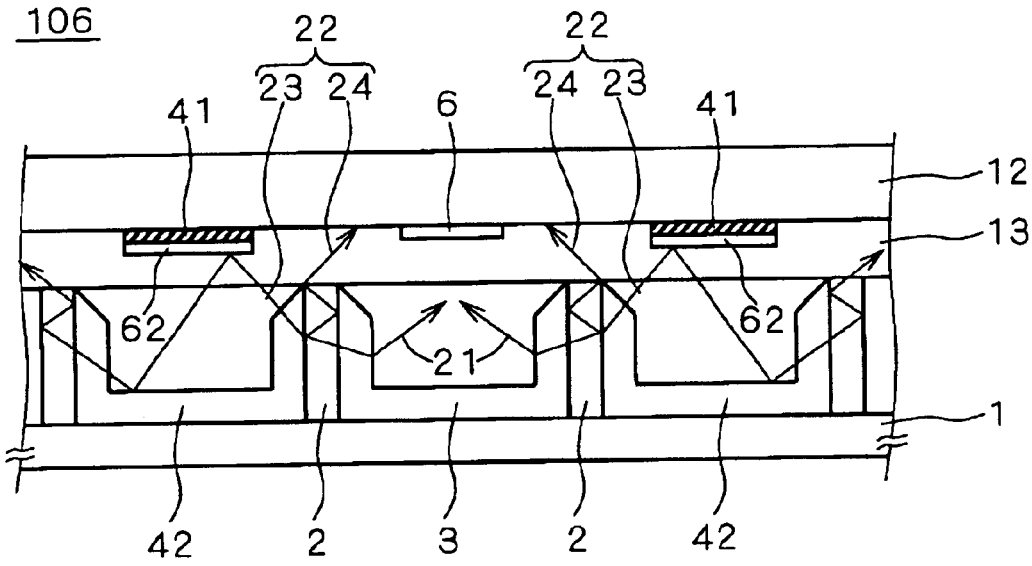
FIG. 14 is a sectional view schematically showing the structure of the PDP of the sixth preferred embodiment.

FIG. 13 is a plan view schematically showing the structure of a PDP 106 according to a sixth preferred embodiment and FIG. 14 is a sectional view schematically showing the structure of the PDP 106 taken along the line E—E in FIG. 13. As shown in FIGS. 13 and 14, the PDP 106 has reflection films 62 formed on the black insulating patterns 41 shown in the PDP 104. In other respects the structure is the same as that of the PDP 104 and not described again.

In the PDP 106, the light 22 traveling toward the non-discharge cells 10 involves not only the light 24 which is reflected at the reflection films 42 and taken out through the barrier ribs 2 onto the display surface, but also light 23 which passes through the reflection films 42 and penetrates into the non-discharge cells 10. In the PDP 104 described above, the light 23 which has penetrated into the non-discharge cells 10 is absorbed in the black insulating patterns 41 and not taken out to the display surface. However, in the PDP 106, the light 23 is reflected at the reflection film 62, travels through the barrier rib 2 as shown in FIG. 14, for example, and is taken out onto the display surface. The light 23 may also pass through the barrier rib 2 and be taken out from the discharge cell 9 to the display surface.

In this way, according to the PDP 106 of the sixth preferred embodiment, the light 23 which has penetrated into the non-discharge cell 10 can be taken out to the display surface without being absorbed in the black insulating pattern 41, so that the luminous efficiency can be enhanced as compared with the PDP 104.

Needless to say, the same effect can be obtained also by providing the reflection films 62 on the black insulating patterns 41 in the PDP 105 of the fifth preferred embodiment or on the black insulating patterns 41 of the PDP 204.

Seventh Preferred Embodiment

Figure 15:
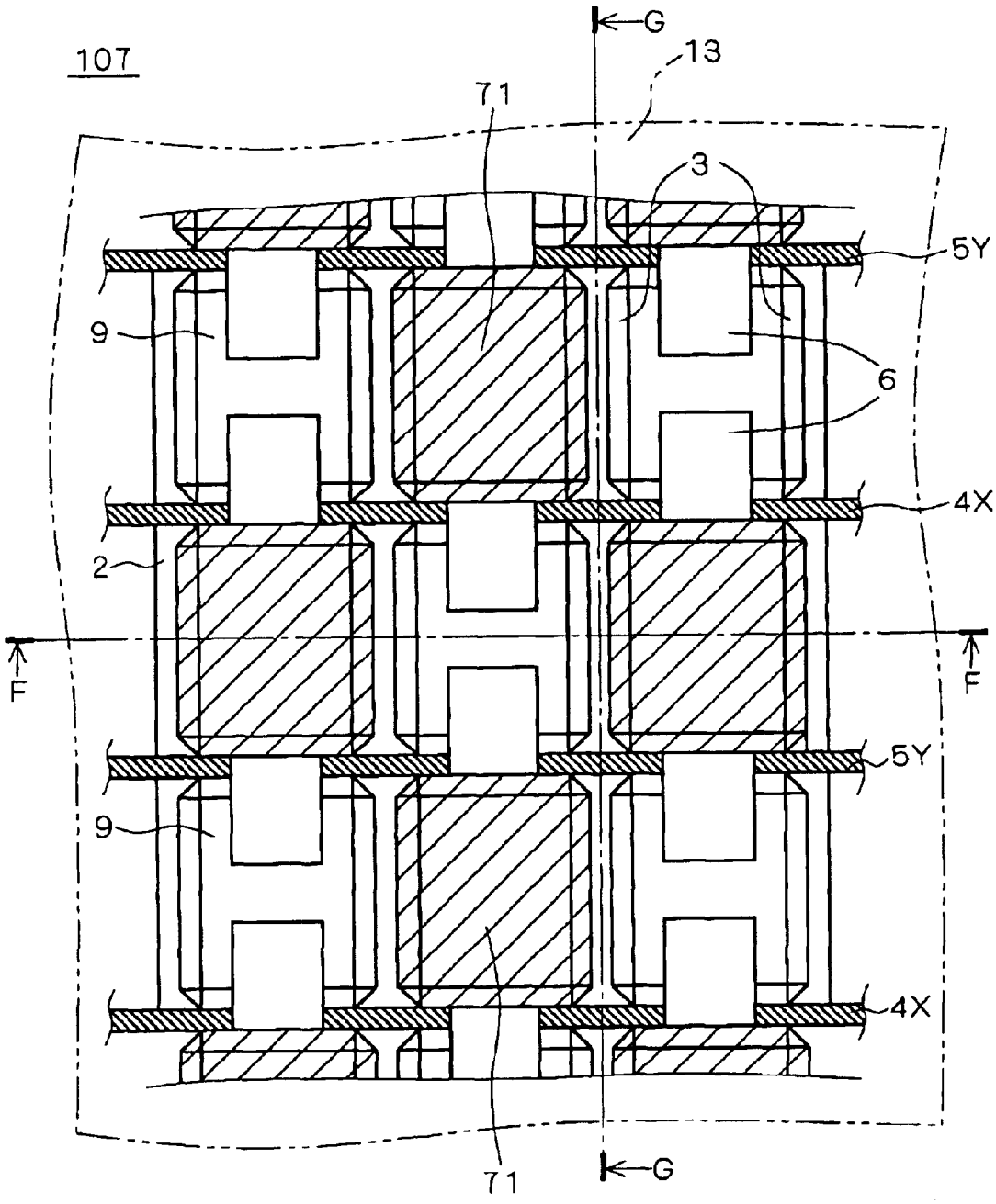
FIG. 15 is a plan view schematically showing the structure of a PDP according to a seventh preferred embodiment.
Figure 16:
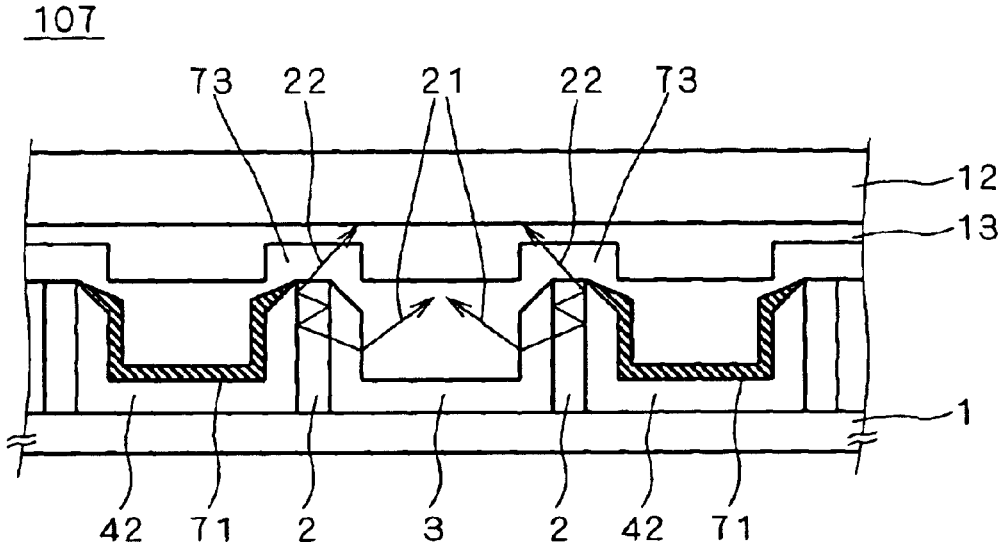
FIGS. 16 and 17 are sectional views schematically showing the structure of the PDP of the seventh preferred embodiment.
Figure 17:
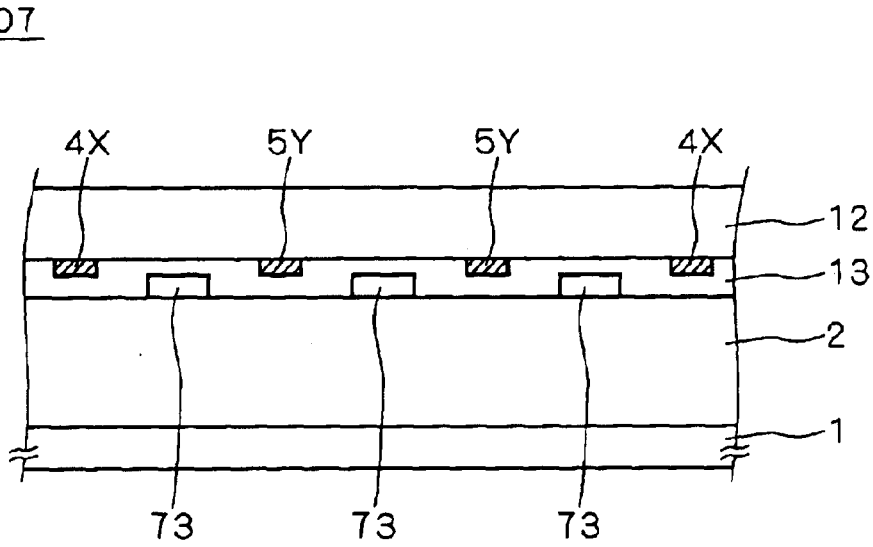

FIG. 15 is a plan view schematically showing the structure of a PDP 107 according to a seventh preferred embodiment. FIG. 16 is a sectional view schematically showing the structure of the PDP 107 taken along the line F—F in FIG. 15 and FIG. 17 is a sectional view schematically showing the structure of the PDP 107 taken along the line G—G in FIG. 15. As shown in FIGS. 15, 16 and 17, the PDP 107 has black insulating films 71 in place of the black insulating patterns 41 of the PDP 104 and indentations 73 in place of the cuts 11. More specifically, the black insulating films 71 are formed on the reflection films 42. For example, the black insulating films 71 can be formed by: mixing black material powder of iron oxide or chromium oxide with a vehicle and a flux to produce a printing paste; applying the printing paste by screen printing in the non-discharge cells 10 and drying it to form powder films on reflection films 42; and firing the resin contained in the vehicle to form the black insulating films 71. The indentations 73 are formed on the front substrate 12 in the regions facing the barrier ribs 2; the indentations 73 are positioned so that they do not overlap the bus electrodes 4X and 5Y. The width of the indentations 73 in the thickness direction of the barrier ribs 2 is set larger than the width of the barrier ribs 2, so that they connect adjacent cell spaces 8 when the front substrate 12 and the back substrate 1 are bonded together. The indentations 73 can be formed, after formation of the dielectric film 13 by screen printing, by removing given parts of the dielectric film 13 by a sandblasting process. While the indentations 73 are positioned so that they do not overlap the bus electrodes 4X and 5Y in the PDP 107, they may be positioned to overlap the bus electrodes 4X and 5Y. In other respects the structure is the same as that of the PDP 104 and not described again.

In the PDP 107, if the cuts 11 are formed in the barrier ribs 2 as in the PDP 104, the black material for the black insulating films 71 would pass through the cuts 11 into the discharge cells 9 during formation of the black insulating films 71 by screen printing. Then the light emission from the phosphors 3 applied in the discharge cells 9 may be absorbed by the black material, causing a reduction in the luminous efficiency. However, the PDP 107, which ensures a vacuum exhaust path with the indentations 73 formed on the front substrate 12 in place of the cuts 11, can avoid the problem that the black material of the black insulating films 71 flows into the discharge cells 9.

In this way, the PDP 107 of the seventh preferred embodiment provides the same effect as the PDP 104 with a different structure. Furthermore, it can avoid reduction in the luminous efficiency since the black material of the black insulating films 71 does not flow into the discharge cells 9.

Figure 18:
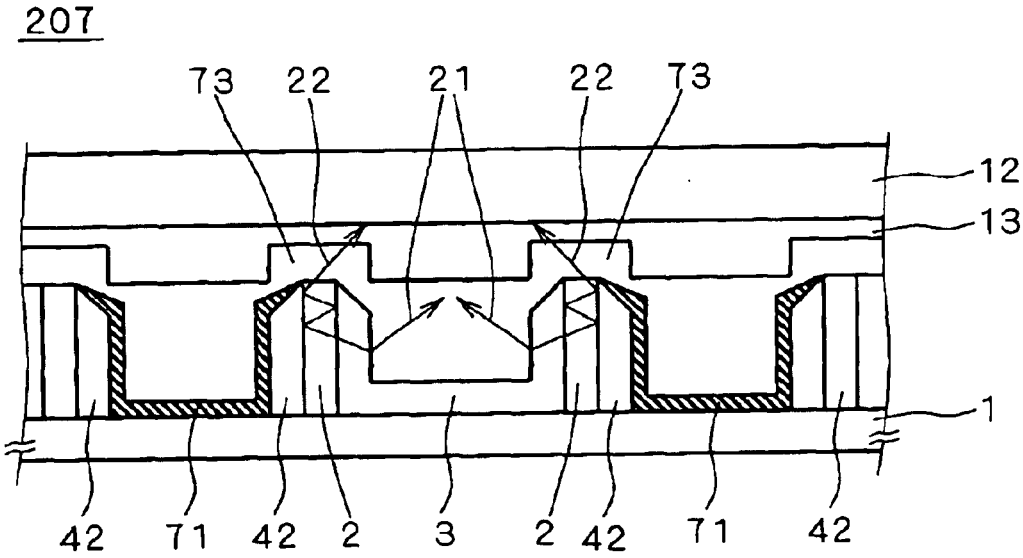
FIG. 18 is a sectional view schematically showing the structure of a PDP according to a variation of the seventh preferred embodiment.

FIG. 18 is a sectional view schematically showing the structure of a PDP 207 which is a variation of the PDP 107. The plan view of the PDP 207 is the same as that schematically shown in FIG. 15 and FIG. 18 is a sectional view taken along the line F—F in FIG. 15. In the PDP 207, the black insulating films 71 are formed on the reflection films 42 and on the back substrate 1 in the PDP 204 described in the fourth preferred embodiment. The PDP 207 thus constructed provides the same effects as the PDP 107.

When the manufacturing process of the PDP 107 and that of the PDP 207 are considered, the PDP 107 provides superior manufacturing efficiency to the PDP 207 since the PDP 207 needs the process of removing the reflection films 42 on the back substrate 1 by a sandblasting process. Considering the process of positioning of the front substrate 12 and the back substrate 1 in a PDP such as the PDP 107 which has the black insulating films 71 formed in the non-discharge cells 10 and in a PDP such as the PDP 104 which has the black insulating patterns 41 formed on the front substrate 12, the PDP having the black insulating patterns 41 on the front substrate 12 requires not only the positioning of the barrier ribs 2 and the bus electrodes 4X, 5Y and the positioning of the transparent electrodes 6 and the discharged cells 9, but also the positioning of the black insulating patterns 41 and the non-discharge cells 10. Thus, high positioning accuracy is needed. The PDP having the black insulating films 71 in the non-discharge cells 10, on the other hand, requires no positioning of the non-discharge cells 10 and the black insulating films 71 since the black insulating films 71 are formed in the non-discharge cells 10. Therefore, the PDP having the black insulating films 71 in the non-discharge cells 10 can further improve the efficiency of manufacturing.

Needless to say, the above-described indentations 73 can be provided in place of the cuts 11 in the PDPs of the first to sixth preferred embodiments and the eighth preferred embodiment described below, so as to form an exhaust path for vacuum evacuation.

Furthermore, the reflection films 42 and 62 in the aforementioned fourth through seventh preferred embodiments may be formed of a phosphor, since the phosphor generally has high reflectance. More specifically, phosphor powder is used instead of the aforementioned powder of $SiO_2$, $Al_2O_3$, or $ZrO_2$, etc. The reflection films 42 and 62 of phosphor can be formed by mixing the phosphor powder with a vehicle and a flux to produce a printing paste, applying and drying the printing paste by screen printing to form powder films on where the reflection films 42 and 62 are formed, and firing the resin contained in the vehicle. The phosphor used for the reflection films 42 and 62 may be any type of phosphor as long as it has high reflectance and does not have to be a phosphor having the property of generating visible radiation by ultraviolet absorption, such as the phosphor 3 filling in the discharge cells 9. For example, it may be a phosphor excited by electron beams, which is used in a cathode-ray tube (CRT). Further, for example if the phosphor for the reflection films 42 and 62 is made of the same material as the phosphor 3 applied in the discharge cells 9, the necessity for using different materials for the reflection films 42, 62 and the phosphor 3 is avoided, which reduces the material cost of the plasma display panel according to each of the preferred embodiments.

Eighth Preferred Embodiment

Figure 19:
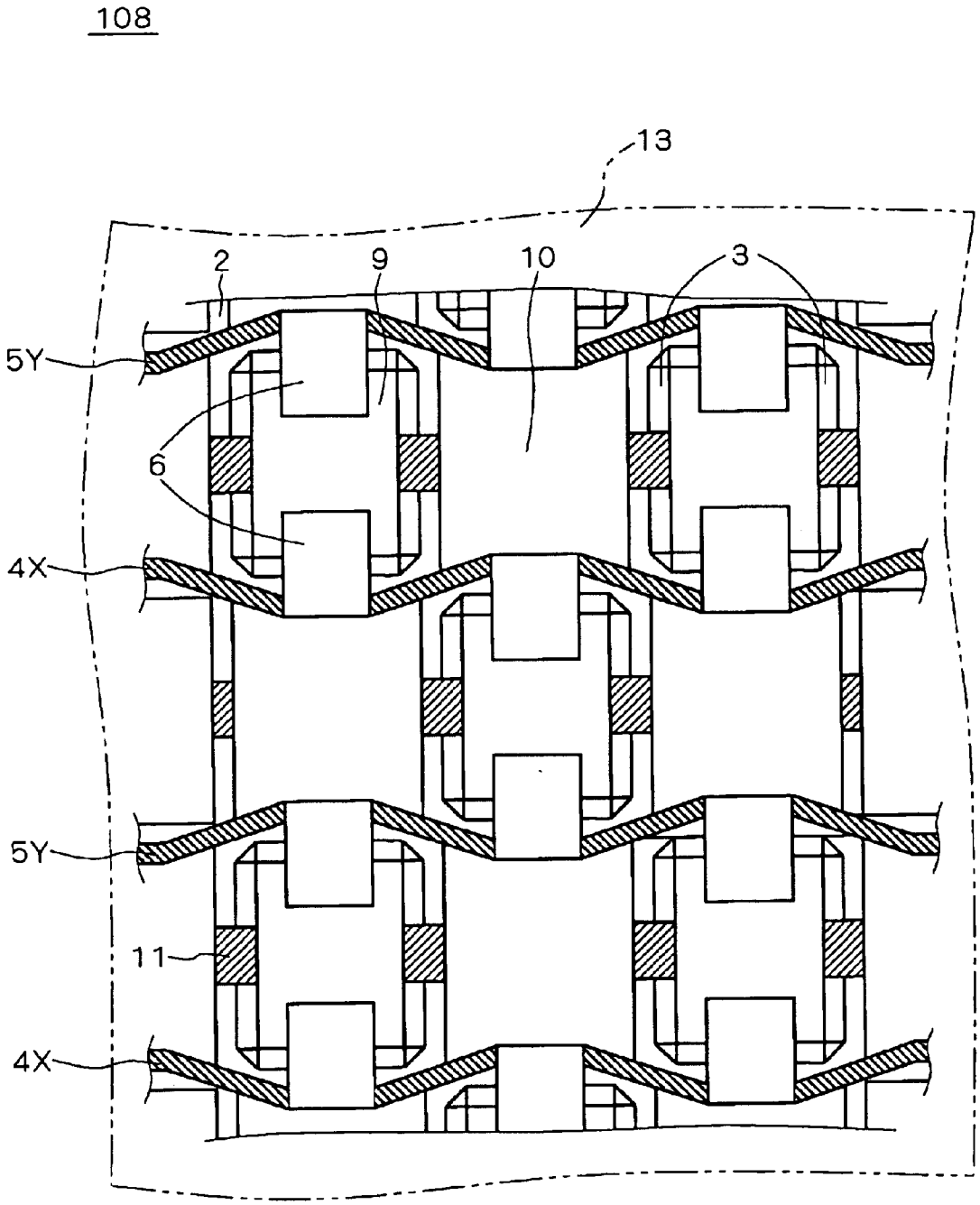
FIG. 19 is a plan view schematically showing the structure of a PDP according to an eighth preferred embodiment.
Figure 20:
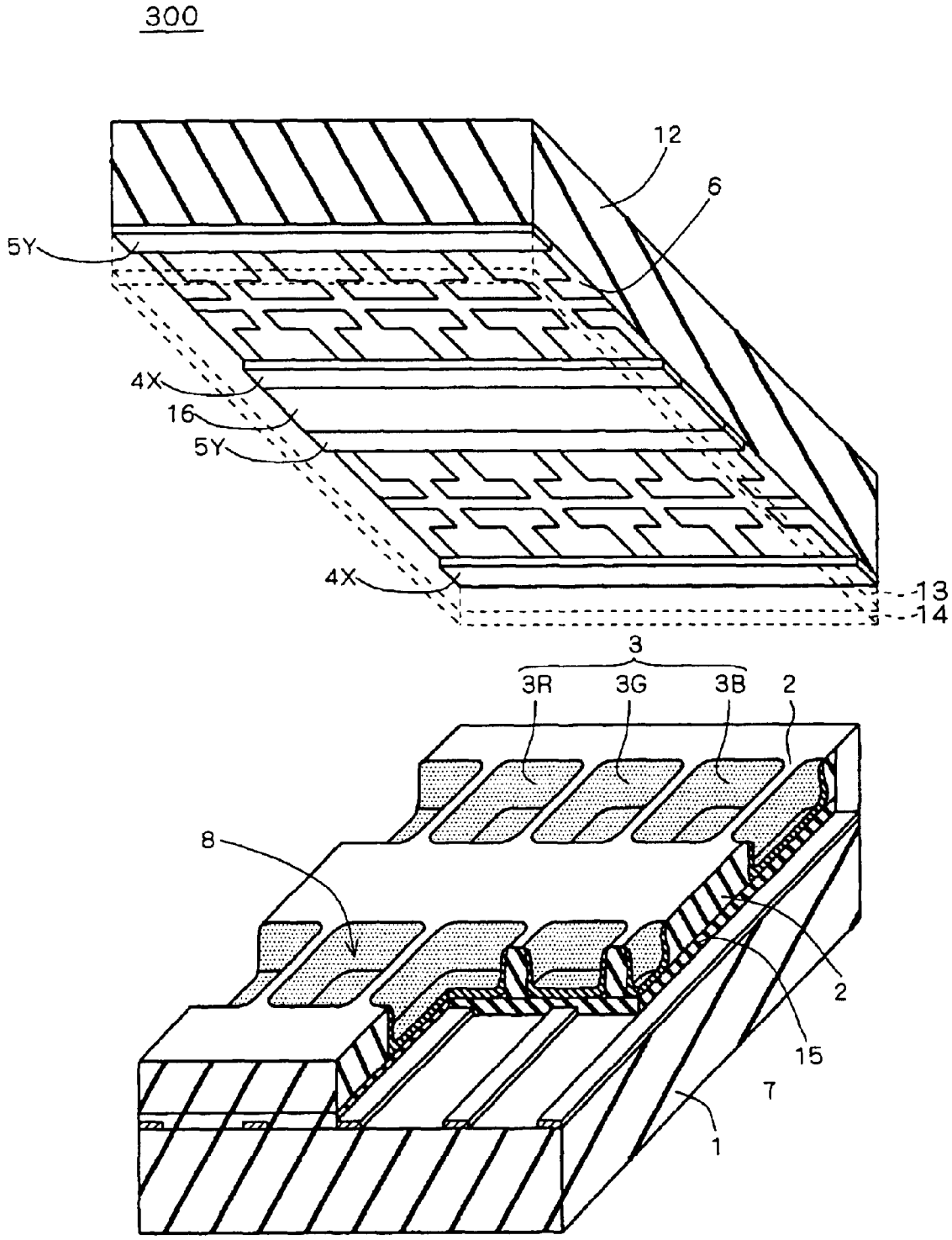
FIG. 20 is a perspective view schematically showing the structure of a conventional PDP.
Figure 21:
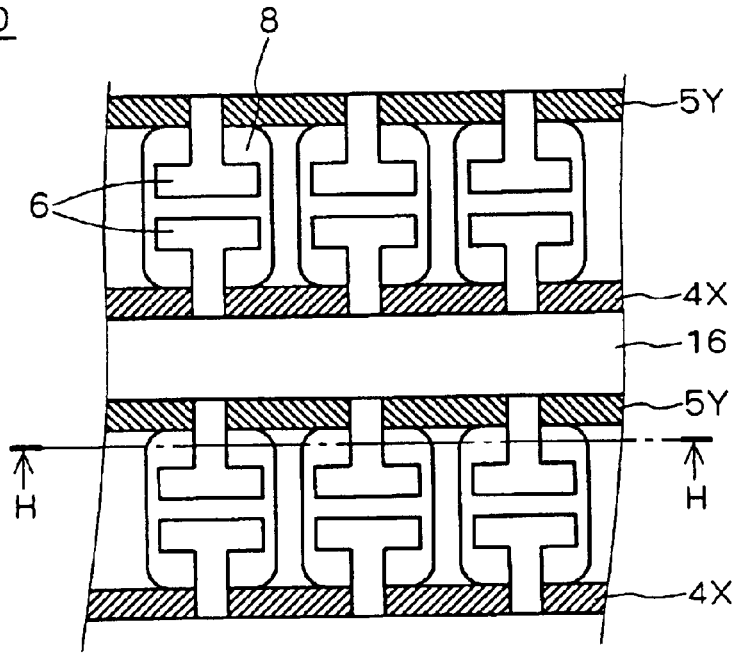
FIG. 21 is a plan view schematically showing the structure of the conventional PDP.
Figure 22:
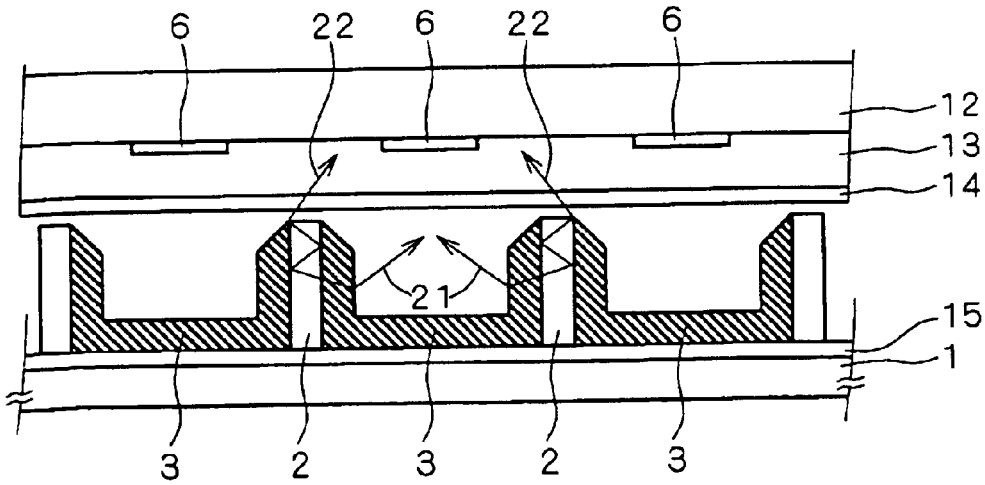
FIG. 22 is a sectional view schematically showing the structure of the conventional PDP.

FIG. 19 is a plan view schematically showing the structure of a PDP 108 according to an eighth preferred embodiment. In the PDP 108, as shown in FIG. 19, the bus electrodes 4X and 5Y in the PDP 101 are modified in shape. More specifically, in the PDP 108, the bus electrodes 4X and 5Y in the PDP 101 which are arranged along and over the barrier ribs 2 are shifted toward the non-discharge cells 10.

The PDP 101 requires high precision in positioning technique since the front substrate 12 and the back substrate 1 must be relatively positioned and bonded together so that the bus electrodes 4X and 5Y lie over the barrier ribs 2. Therefore, if the front substrate 12 and the back substrate 1 are poorly positioned, the bus electrodes 4X and 5Y may extend over the discharge cells 9 and block the light emission in the discharge cells 9, in which case the luminance is reduced. In contrast, in the PDP 108, the bus electrodes 4X and 5Y are shifted toward the adjacent non-discharge cells 10, so that a slight error in relatively positioning the front substrate 12 and the back substrate 1 does not cause the bus electrodes 4X and 5Y to protrude over the discharge cells 9.

In this way, the PDP 108 of the eighth preferred embodiment allows the positioning precision to be relaxed and more effectively prevents reduction in emission luminance than the PDP 101.

The PDPs of the first to eighth preferred embodiments can be combined with a known driving circuit etc. for driving the PDP to provide a plasma display device having the effects described above.

While the invention has been described in detail, the foregoing description is in all aspects illustrative and not restrictive. It is understood that numerous other modifications and variations can be devised without departing from the scope of the invention.

What is claimed is:

1. A plasma display panel comprising:

a first substrate forming a display surface;

a second substrate placed to face said first substrate at a given distance; and barrier ribs sectioning a space between said first substrate and said second substrate into a plurality of independent cell spaces;

wherein said plurality of cell spaces comprise a plurality of discharge cells and a plurality of non-discharge cells, and said plurality of discharge cells and said plurality of non-discharge cells are arranged so that each said discharge cell adjoins at least one said non-discharge cell.

2. The plasma display panel according to claim 1, wherein a phosphor is applied in said discharge cells and no phosphor is applied in said non-discharge cells.

3. The plasma display panel according to claim 1, further comprising black insulating films provided on said second substrate in regions corresponding to said non-discharge cells.

4. The plasma display panel according to claim 1, further comprising, first reflection films provided on sides of said barrier ribs in regions corresponding to said non-discharge cells, and black insulating patterns provided on said first substrate in the regions corresponding to said non-discharge cells.

5. The plasma display panel according to claim 4, wherein said first reflection films are provided also on said second substrate in the regions corresponding to said non-discharge cells.

6. The plasma display panel according to claim 4, wherein said black insulating patterns on said first substrate are partially provided also in regions facing said barrier ribs.

7. The plasma display panel according to claim 4, wherein said first reflection films are formed of a phosphor.

8. The plasma display panel according to claim 4, further comprising second reflection films provided on said black insulating patterns.

9. The plasma display panel according to claim 8, wherein said second reflection films are formed of a phosphor.

10. The plasma display panel according to claim 1, further comprising:

reflection films provided on sides of said barrier ribs in regions corresponding to said non-discharge cells; and black insulating films provided on said reflection films and on said second substrate in the regions corresponding to said non-discharge cells.

11. The plasma display panel according to claim 10, wherein said reflection films are formed of a phosphor.

12. The plasma display panel according to claim 1, further comprising, reflection films provided on sides of said barrier ribs in regions corresponding to said non-discharge cells and on said second substrate in the regions corresponding to said non-discharge cells, and black insulating films provided on said reflection films.

13. The plasma display panel according to claim 12, wherein said reflection films are formed of a phosphor.

14. The plasma display panel according to claim 1, further comprising sustain electrodes comprising first electrodes and second electrodes provided on said first substrate, wherein said first electrodes on said first substrate are arranged over said barrier ribs along a plurality of said discharge cells, and said second electrodes on said first substrate are arranged to protrude from said first electrodes only over said discharge cells.

15. The plasma display panel according to claim 14, wherein said first electrodes are arranged over said barrier ribs while being shifted toward said non-discharge cells.

16. The plasma display panel according to claim 1, wherein said barrier ribs comprise cuts formed in parts which face said first substrate, said cuts connecting adjacent said cell spaces.

17. The plasma display panel according to claim 1, wherein said first substrate comprises indentations formed in regions facing said barrier ribs, said indentations connecting adjacent said cell spaces.

18. The plasma display panel according to claim 1, wherein said discharge cells and said non-discharge cells are arranged in a matrix, and said discharge cells and said non-discharge cells are alternated horizontally and vertically.

19. The plasma display panel according to claim 1, wherein said discharge cells occupy a larger area in said display surface than said non-discharge cells.

20. A plasma display device comprising a plasma display panel, said plasma display panel comprising:

a first substrate forming a display surface;

a second substrate placed to face said first substrate at a given distance; and barrier ribs sectioning a space between said first substrate and said second substrate into a plurality of independent cell spaces, wherein said plurality of cell spaces comprise a plurality of discharge cells and a plurality of non-discharge cells, and said plurality of discharge cells and said plurality of non-discharge cells are arranged so that each said discharge cell adjoins at least one said non-discharge cell.

* * * * *